US012716320B2

(12) United States Patent
Antonsen et al.

(10) Patent No.: US 12,716,320 B2
(45) Date of Patent: Aug. 25, 2026

(54) METHODS AND SYSTEMS FOR ROTATING A CASING TO ENSURE EFFICIENT DISPLACEMENT OF CEMENT SLURRY

(71) Applicant: Nesa Energy LLC, Austin, TX (US)

(72) Inventors: Roger Antonsen, Katy, TX (US); Michael Sepulveda, Houston, TX (US); Sigurd Eirik Sperbund, Houston, TX (US)

(73) Assignee: Nesa Energy LLC, Austin, TX (US)

( * ) Notice: Subject to any disclaimer, the term of this patent is extended or adjusted under 35 U.S.C. 154(b) by 0 days.

(21) Appl. No.: 19/284,309

(22) Filed: Jul. 29, 2025

(65) Prior Publication Data

US 2025/0354453 A1 Nov. 20, 2025

Related U.S. Application Data

(63) Continuation of application No. PCT/US2024/026821, filed on Apr. 29, 2024.

(60) Provisional application No. 63/464,477, filed on May 5, 2023.

(51) Int. Cl.
*E21B 33/13* (2006.01)

(52) U.S. Cl.
CPC ..... *E21B 33/13* (2013.01)

(58) Field of Classification Search
CPC ..... E21B 33/13; E21B 33/134; E21B 33/136; E21B 33/138; E21B 33/14; E21B 33/143; E21B 33/146; E21B 33/16; E21B 33/165; E21B 33/167
See application file for complete search history.

(56) References Cited

U.S. PATENT DOCUMENTS 3,667,547 A * 6/1972 Ahlstone ..... E21B 33/043 166/301
2020/0370387 A1* 11/2020 Wang ..... E21B 23/00

* cited by examiner

*Primary Examiner* — Yanick A Akaragwe
(74) *Attorney, Agent, or Firm* — Pierson IP, PLLC

(57) ABSTRACT

Rotating a casing during a cementing operation to ensure efficient displacement of cement slurry. More specifically, embodiments are directed towards a sub and rotating tool that are positioned above a first cement operation, wherein the rotating tool is positioned in a kickoff point or build section of a horizontal well.

9 Claims, 22 Drawing Sheets

METHODS AND SYSTEMS FOR ROTATING A CASING TO ENSURE EFFICIENT DISPLACEMENT OF CEMENT SLURRY

BACKGROUND INFORMATION

Field of the Disclosure

Examples of the present disclosure relate to systems and methods for rotating a portion of the casing during a cementing operation to ensure efficient displacement of cement slurry. More specifically, embodiments are directed towards a sub and rotating tool that utilize a stroke tool, wherein the stroke tool is configured to lift a casing hanger seal assembly from a wellhead, wherein a proximal end of the seal assembly is configured to be rotated when outside of the wellhead to rotate a downhole swivel.

Background

Directional drilling is the practice of drilling non-vertical wells. Deviated wells tend to be more productive than vertical wells because they allow a single well to reach multiple points of the producing formation across a horizontal axis without the need for additional vertical wells. This makes each well more productive by being able to reach reservoirs across the horizontal axis. While horizontal wells are more productive than conventional wells, horizontal wells are costlier.

Conventionally, the casing is run in hole, and cement is pumped through the inner diameter of the casing. Subsequently, the cement is displaced through the inner diameter of the casing string and separated from a spacer and drilling fluid via wipers and other systems. Float collars are conventionally run in at the toe of the section of a well to establish circulation and to prevent back-flow entering the inside of the casing string.

However, due to the length and weight of a string and wellbore geometry, it is often impossible to rotate an entire casing, liner, or string during displacement. A second stage cement job will be performed due to the restriction of the pore pressure and fracture gradient of the formation. To prevent formation breakdown, the casing string is cemented in two stages, hydraulically isolating the first and second stages.

Furthermore, when cementing downhole it may be beneficial to rotate the string to evenly disperse the cement. However, it may not be possible to rotate a casing hanger within the wellhead seal surface area.

Accordingly, needs exist for systems and methods for a sub and rotating tool that are positioned above a first cement operation that utilize a stroke tool that is configured to lift a seal assembly from a wellhead, wherein a proximal end of the seal assembly is configured to be rotated when outside of the wellhead to rotate a downhole swivel.

SUMMARY

Examples of the present disclosure relate to systems and methods for a rotating tool that is positioned above a first cementing operation, wherein the rotating tool utilizes a stroke tool that is configured to lift a seal assembly from a wellhead. In embodiments, a proximal end of the seal assembly is configured to be rotated when outside of the wellhead to rotate a downhole swivel. Specifically, the rotating tool may be positioned at a location where it is estimated that the formation will (breakdown) crack due to hydrostatic pressure within an annulus between the rotating tool and the formation. The seal assembly may be coupled to the downhole swivel, and may be configured to be pulled out of the wellhead before the swivel operation, maintained outside of the wellhead during the swivel operation, and may land within the wellhead seal surface area after the swivel operation.

The first rotating tool may include a first inner housing and a first outer housing, wherein the outer housing is coupled to a casing string. The first inner housing may be configured to receive forces to rotate the first outer housing. Responsive to the first inner housing rotating in a first direction, the first inner housing may freely rotate by transferring these forces to the outer housing due to a clutch positioned between the first inner and first outer housing. As such, the clutch may enable the inner housing to freely rotate above the clutch when rotating in a first direction, and the clutch transfers rotational forces to the casing string below the first rotating tool, via the outer housing, to rotate when rotated in a second direction.

In embodiments, a first-stage cement job may be executed as a normal standard cement job of any casing/liner string, wherein the first-stage cement job may be pumped through the first rotating tool. Specifically, before pumping cement, the stroke tool above the first rotating tool may be pulled upward to position a proximal end of the seal assembly outside of the well assembly. A burst disc associated with the first stage cement job may burst at between 200-350 psi. The casing and liner hanger may be rotated or circulated at least for one string volume to clean the string and to condition the wellbore. A spacer may then be pumped downhole, and an additional wiper plug or any other object (referred to hereinafter collectively and individually as "wiper plug") that may activate downhole tools may be pumped downhole to physically separate the spacer from the cement, to separate the cement from the displacement fluid, and to clean the inner diameter of the tool. In embodiments, once the top plug has landed on the collar at the bottom of the first stage cement job, the string in the wellhead may be hung, the entire string may be pressurized to radially expand a first packer, and the integrity of the string may be verified. The first packer may be set across an annulus to isolate a first zone positioned below the packer from a second zone outside of the packer. The integrity of the first stage cement job may be set at approximately 1200 psi.

Then, a second stage cementing job within the second zone may be completed above the first rotating tool with a sub or housing tool while the first packer isolates the first zone from the second zone. The sub may include a burst disc or any other removable object (referred to hereinafter collectively and individually as "burst disc") positioned within a burst disc port, communication ports, a lower sleeve, and an upper sleeve. In embodiments, the first packer positioned below the rotating tool may expand across the annulus at a psi of approximately 2500 psi, and pressure may be configured to build within the housing to burst the burst disc. When the burst disc ruptures, a burst disc port may be exposed, wherein the burst disc may burst at approximately 3000-3500 psi. This may establish circulation within the inner diameter of the housing and the annulus. Then, a first wiper plug may be launched, land on the first lower sleeve, and move the lower sleeve at approximately 1000 psi. This movement of the first lower sleeve may expose a communication port while closing and sealing off the burst disc port.

Cement may then circulate or be displaced at 6-8 bbbls/min into the annulus while rotating the upper part of the string at 15-30 rpm to uniformly displace the cement into the annulus. In embodiments, before rotating, a stroke tool may lift the seal assembly from the wellhead, wherein the proximal end of the seal assembly is configured to be rotated when outside of the wellhead to rotate a downhole swivel. This may ensure annular cement well barrier element integrity when creating a zonal isolation barrier, while also not allowing the rotation of the seal assembly while the seal assembly is within the wellhead seal surface area. Next, a second wiper plug may be launched, land on the upper sleeve, move the upper sleeve at approximately 1500 psi, close the first communication ports, and lock the upper sleeve in position. Once the first upper sleeve is locked in position, the first rotating tool may stop rotating, the casing string may hang off, and the upper part of the casing string above the rotating tool may be pressure tested to verify integrity at approximately 4500 psi. The landing profile in the first lower and first upper sleeve will be drilled/milled away to ensure the full inner diameter of the casing string, thus not causing any restriction of the casing string.

In other embodiments, the plug system may be run in the hole as part of the upper completions, which may be positioned just above a production packer. This may eliminate fluid at a stage of the well, which may reduce intervention complexity. For example, instead of running wireline tools, a plug system can be deployed from the surface and pumped down to open the port collar, while sealing off the reservoir.

A second rotating tool may include a second inner housing and a second outer housing, wherein the second outer housing is coupled to a casing string. The second inner housing may be configured to receive forces to rotate the second outer housing. Responsive to the second inner housing rotating in a first direction, the second inner housing may freely rotate by transferring these forces to the outer housing due to a clutch positioned between the second inner and second outer housing. As such, the clutch may enable the inner housing to freely rotate above the clutch when rotating in a first direction, and the clutch transfer rotation forces to the casing string below the second rotating tool, via the outer housing, to rotate when rotated in a second direction. For example, before the first rotating tool is cemented in place, the first rotating tool may be rotated in the second direction based on rotational forces from the second rotating tool.

After the second zone has been cemented, a second packer may be inflated to isolate a third zone from the second zone within the annulus, wherein the third zone may be positioned above the second zone. Then, a third stage cementing job within the third zone may be completed above the first rotating tool within the sub or housing while the second packer isolates the second zone from the third zone. In embodiments, the second packer positioned below a second rotating tool may expand across the annulus at a psi of approximately 2600 psi, wherein the PSI associated with inflating the second packer may be higher than a PSI to inflate the first packer, and pressure may be configured to build within the housing to burst a second burst disc. When the second burst disc ruptures a burst disc port may be exposed, wherein the second burst disc may burst at approximately 3000-3500 psi. This may establish circulation within the inner diameter of the housing and the third zone within the annulus. Then, a third wiper plug may be launched, land on the second lower sleeve, and move the second lower sleeve at approximately 1000 psi. This movement of the second lower sleeve may expose a second communication port while closing and sealing off the burst disc port.

Cement may then circulate or be displaced at 6-8 bbbls/min into the annulus while rotating the upper part of the string at 15-30 rpm to uniformly displace the cement into the third zone within the annulus. In embodiments before rotating, the stroke tool may lift the seal assembly from the wellhead, wherein the proximal end of the seal assembly is configured to be rotated when outside of the wellhead to rotate a downhole swivel. Next, a fourth wiper plug may be launched, land on the second upper sleeve, move the second upper sleeve at approximately 15000 psi, close the second communication ports, and lock the second upper sleeve in position. Once the second upper sleeve is locked in position, the second rotating tool may stop rotating, the casing string may hang off, and the upper part of the casing string above the rotating tool may be pressure tested to verify integrity at approximately 4500 psi.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions, or rearrangements may be made within the scope of the invention, and the invention includes all such substitutions, modifications, additions, or rearrangements.

BRIEF DESCRIPTION OF THE DRAWINGS

Non-limiting and non-exhaustive embodiments of the present invention are described concerning the following figures, wherein reference numerals refer to like parts throughout the various views unless otherwise specified.

Figure 1:
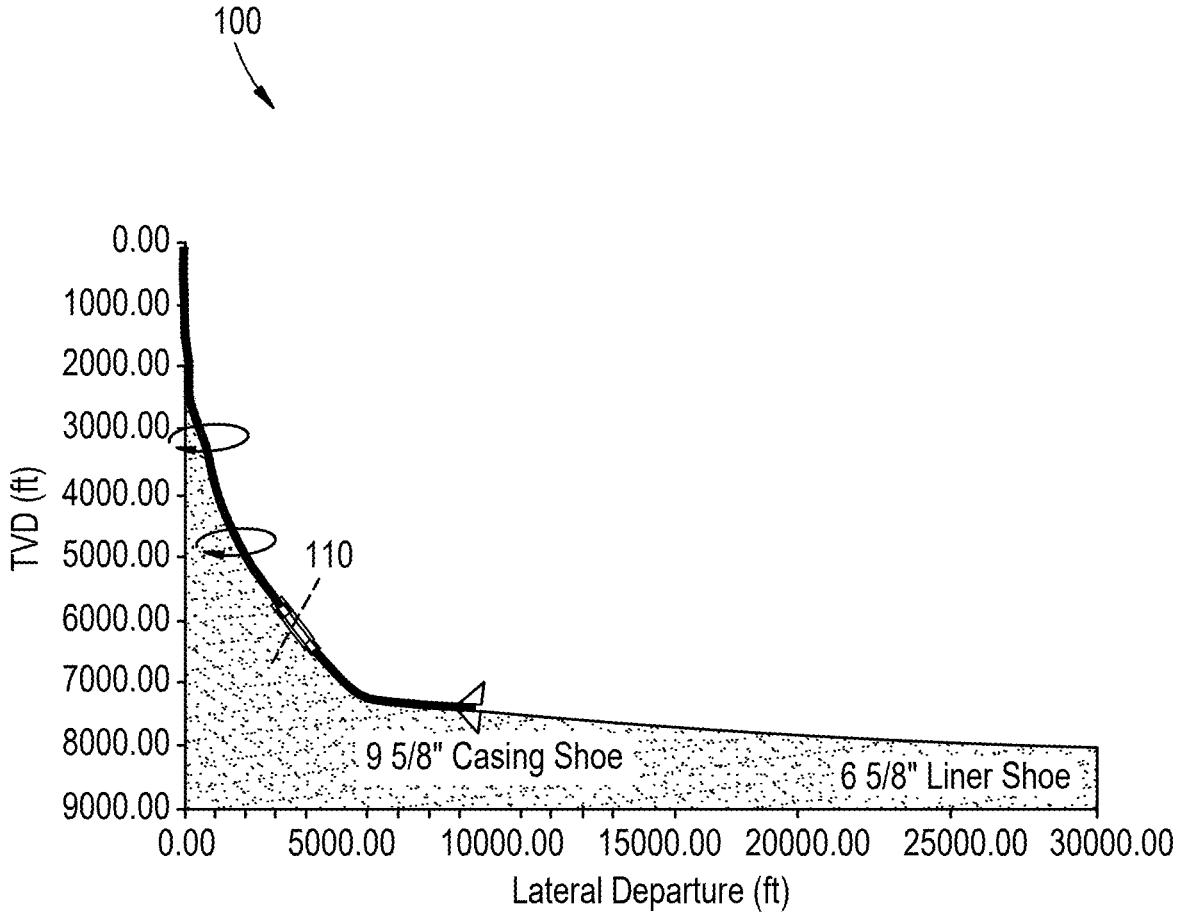
FIG. 1 depicts the relative placement of a rotating tool within a wellbore, according to an embodiment.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help improve understanding of various embodiments of the present disclosure. Also, common but well-understood elements that are useful or necessary in a commercially feasible embodiment are often not depicted to facilitate a less obstructed view of these various embodiments of the present disclosure.

DETAILED DESCRIPTION

In the following description, numerous specific details are outlined to provide a thorough understanding of the present embodiments. It will be apparent, however, to one having ordinary skill in the art, that the specific detail need not be employed to practice the present embodiments. In other instances, well-known materials or methods have not been described in detail to avoid obscuring the present embodiments.

Figure 2:
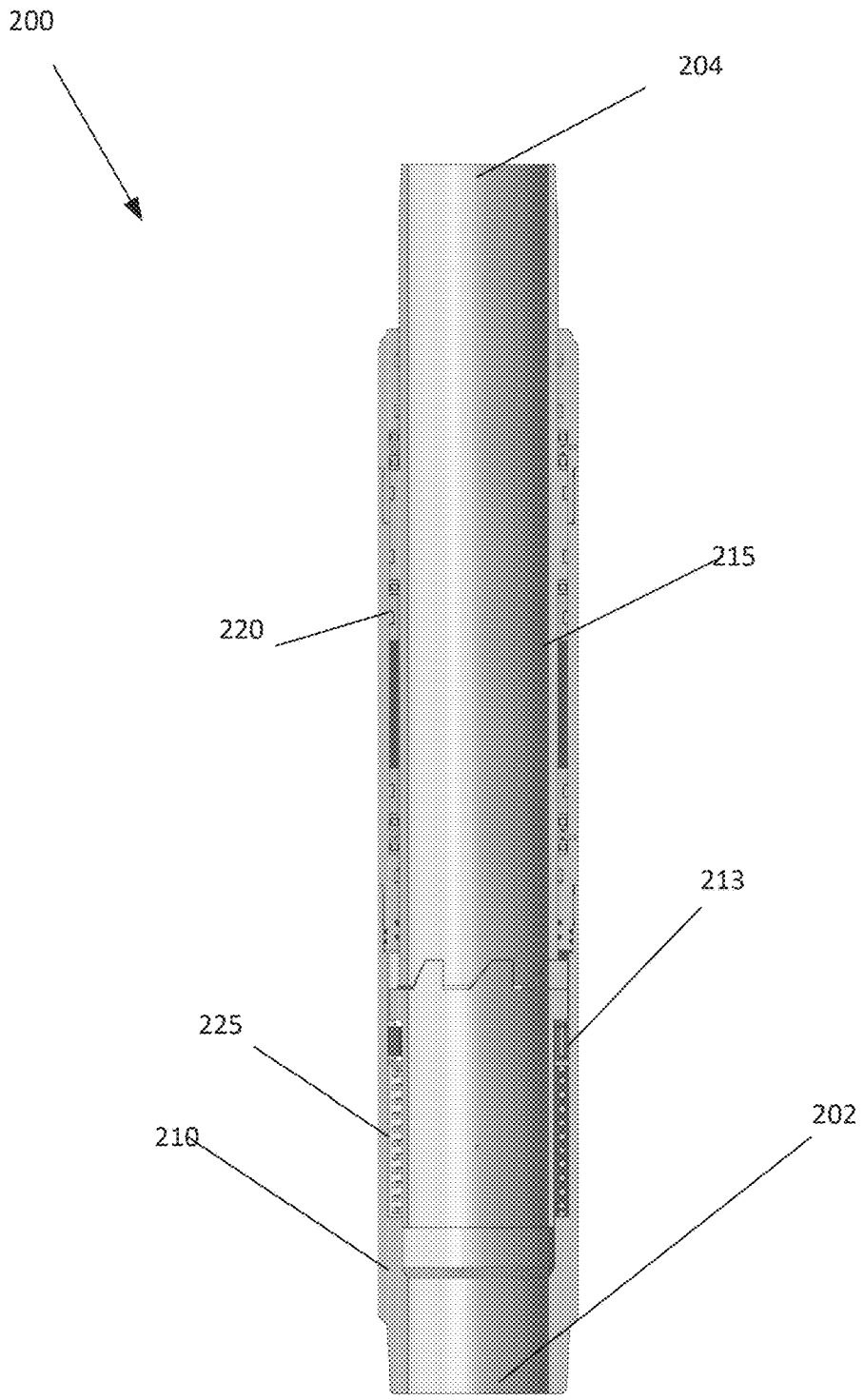
FIG. 2 depicts a rotating tool, according to an embodiment.

FIG. 1 depicts a relative placement of a rotating tool 110 within a wellbore 100, according to an embodiment. Rotating tool 110 may be positioned in a kickoff point or build section of wellbore 100. Specifically, rotating tool 110 may be positioned at a location where it is estimated that the formation will fracture due to hydrostatic pressure within an annulus between the rotating tool and the formation, and where the upper part above the rotating tool can be rotated without restrictions/limitations FIG. 2 depicts a rotating tool 200, according to an embodiment. In embodiments, rotating tool 200 may be configured to rotate in a first direction, such as a right-hand turn, while being restricted in rotating in a second direction, such as a left-hand turn. Rotating tool 200 may include a downhole end 202 and an uphole end 204, wherein downhole end 202 may be coupled to existing casing, which may be created during a first casing operation. Up-hole end 204 may be coupled to up-hole tools, such as a wiper collar that is configured to receive a first and second wiper. Responsive to rotating tool 200 rotating in a first direction, the uphole tools may correspondingly rotate while the downhole tools remain stationary, and rotating the rotating tool 200 in a second direction may cause the downhole tools to correspondingly rotate. In embodiments, rotating tool 200 may include outer housing 210, inner housing 215, rotating element 220, and spring 225. The inner diameter of the tool is equal to or larger than the inner diameter of the casing string in use.

Outer housing 210 may be configured to be positioned on an outer diameter of inner housing 215. Outer housing 210 may be configured to receive forces via clutch 213 when inner housing 215 is rotating in a second direction to rotate outer housing. However, when inner housing 215 rotates in the first direction, clutch 213 may not transfer these forces to outer housing 210. Rotating element 220 may be positioned within a chamber between inner housing 215 and outer housing 210. Rotating element 220 may be configured to rotate based on a clutch 213. Rotating element 220 for example may be bearings between inner housing 215 and outer housing 210 that include a wheel and a fixed axle, in which the rotating part and the stationary part are separated by a ring of small solid meal balls that reduce friction. Clutch 213 may be configured to allow the transmission of forces in the first rotational direction while locking up when rotating in the second direction. Rotating element 220 may also include bearings that allow clutch 213 to engage and disengage based on the rotational direction of rotating element 220. Spring 225 may be configured to be positioned between an upper surface of rotating element 220 and a ledge on outer housing 210. Spring 225 may be configured to assist in receiving compressive forces against rotating tool 200 when rotating tool 200 is rotating.

Figure 3:
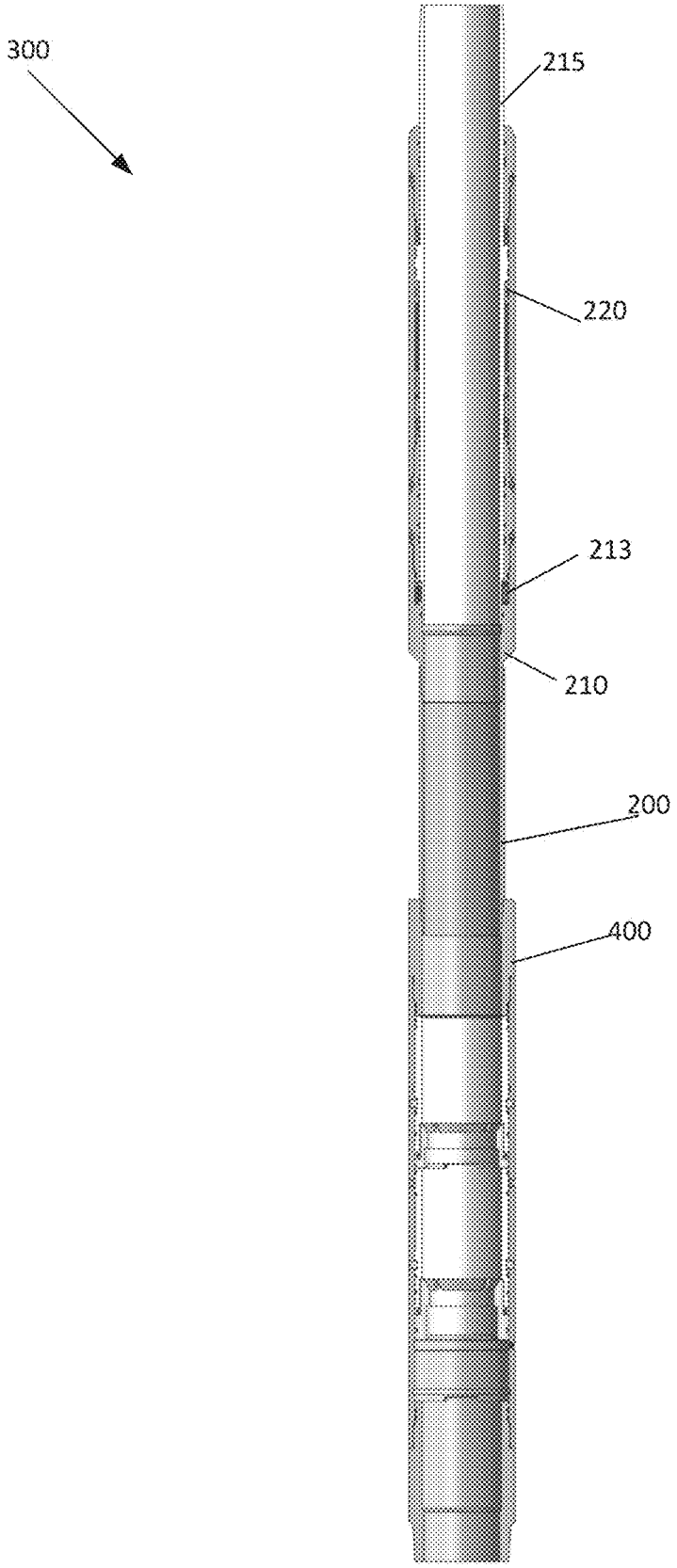
FIG. 3 depicts a rotating tool, according to an embodiment.

FIG. 3 depicts a rotating tool 300, according to an embodiment. Elements depicted in FIG. 3 may be described above, and for the sake of brevity, a further description of these elements may be omitted.

As depicted in FIG. 3, rotating element 220 may be positioned between outer housing 210 and inner housing 215. In embodiments, rotating element 220 may be positioned within a chamber without springs 225.

Figure 4:
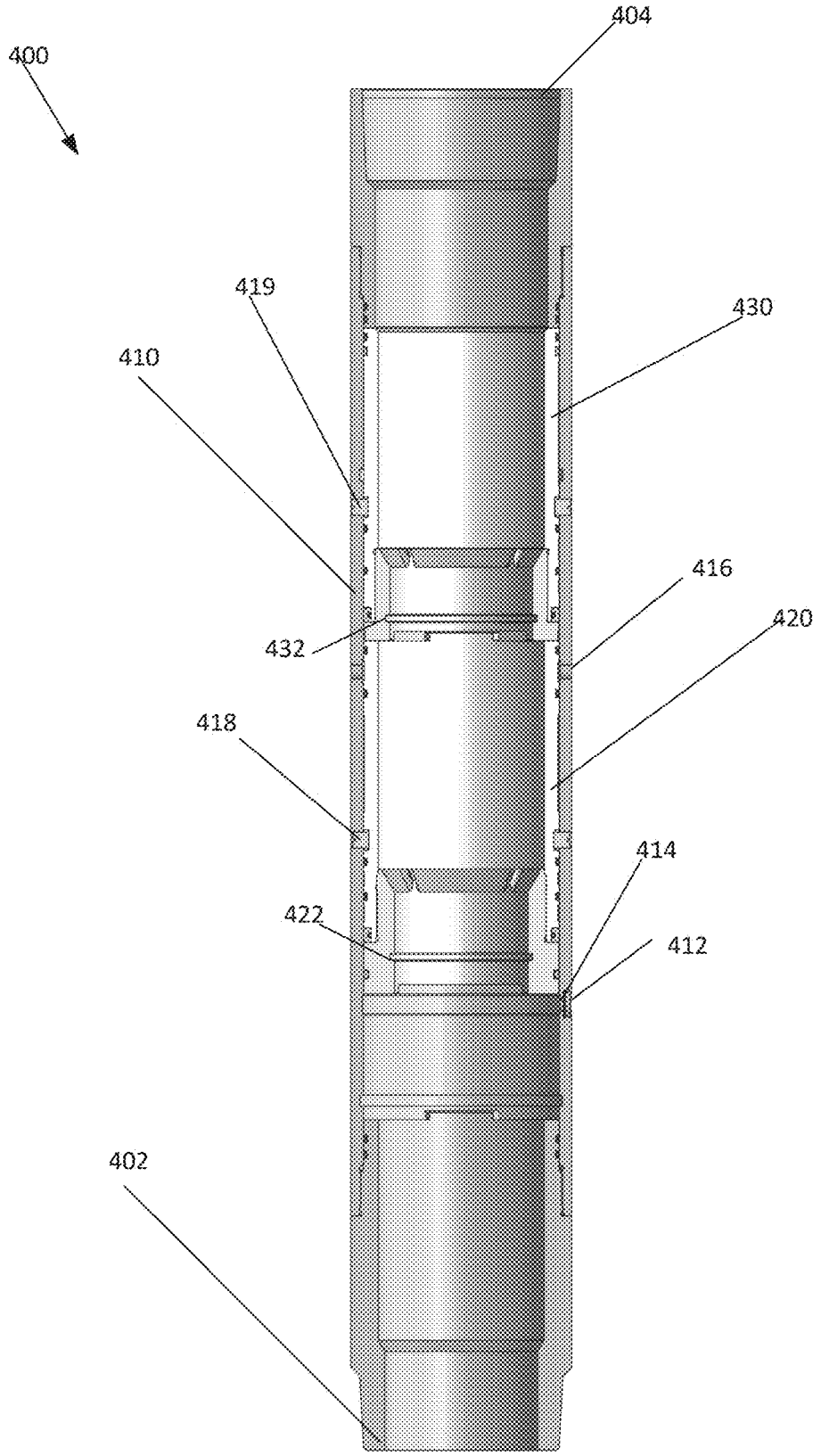
FIG. 4 depicts a sub, according to an embodiment.

FIG. 4 depicts a sub-400, according to an embodiment. Sub 400 may be configured to receive a first wiper plug and a second plug to complete a cementing operation. A distal end 402 of sub 400 may be mechanically coupled to the proximal end 202 of rotating tool 200. Responsive to the rotating tool 200 rotating, sub 400 may correspondingly rotate. This may enable sub 400 to rotate while emitting cement into an annulus between the outer diameter of sub 400 and the inner diameter of a geological formation.

Sub 400 may include a housing 410, a first sleeve 420, and a second sleeve 430. Housing 410 may be a 9⅝" casing that is configured to receive mechanical forces from rotating tool 200 to rotate. Housing 410 may also be configured to house the elements of sub-400. Housing 410 may include a burst disc port 412, communication port 416, first shear pin 418, and second shear pin 419.

Burst disc port 412 may be configured to extend from an inner diameter of sub-400 to an annulus positioned outside of an outer diameter of sub-400. When run in a hole, burst disc port 412 may not be covered by first sleeve 410. However, after the first sleeve 410 slides downhole, the first sleeve 410 may cover burst disc port 412. Burst disc port 412 may be configured to house a burst disc 414 when burst disc 414 is intact. Burst disc 414 may be a disc that is configured to break after a first-stage cement job, wherein burst disc 414 ruptured based upon a pressure applied against burst disc 414 or a pressure differential across burst disc 414 being greater than a pressure threshold. For example, the pressure threshold to rupture burst disc 414 may be between 3000-3500 psi, which may be substantially greater than a burst disc associated with a sub positioned below rotating tool 200. When burst disc 414 is intact, burst disc 414 may be configured to block communication across burst disc port 412. However, when the burst disc 414 is broken and burst disc port 412 is not covered, then the annulus outside of sub 400 and the inner diameter of sub 400 may be in communication. In embodiments, after the burst disc 414 bursts, circulation may be established between the inner diameter and annulus of sub-400, and then a first wiper plug may be launched.

Communication port 416 may be a port extending from the inner diameter of sub 400 to the annulus positioned outside of an outer diameter of sub 400. In embodiments, communication port 416 may be positioned between burst disc port 412 and proximal end 404, and may also be positioned between first shear pin 418 and second shear pin 419. Communication port 416 may be covered by first sleeve 420 when sub 400 is run in a hole, uncovered when first sleeve 420 slides towards distal end 402 and second sleeve 430 is coupled to housing 410 via second shear pin 419, and covered when second sleeve 430 slides towards distal end 402.

First, shear pin 418 may be configured to selectively couple first sleeve 420 with housing 410. First, shear pin 418 may be configured to shear responsive to a pressure being applied to the first shear pin 418 being greater than a first threshold. Responsive to first shear pin 418 shearing, first sleeve 4120 may be configured to slide towards distal end 402. In embodiments, first shear pin 418 may be configured to shear responsive to a wiper plug landing on first sleeve 420, causing a pressure above first sleeve 420 to increase past the first threshold.

Second shear pin 419 may be configured to selectively couple second sleeve 430 with housing 410. Second shear pin 419 may be configured to shear responsive to pressure being applied to second shear pin 419 being greater than a second threshold. Responsive to second shear pin 419 shearing, second sleeve 430 may be configured to slide towards distal end 402. In embodiments, second shear pin 419 may be configured to shear responsive to a wiper plug landing on second sleeve 430, causing a pressure above second sleeve 430 to increase past the second threshold.

Figure 5:
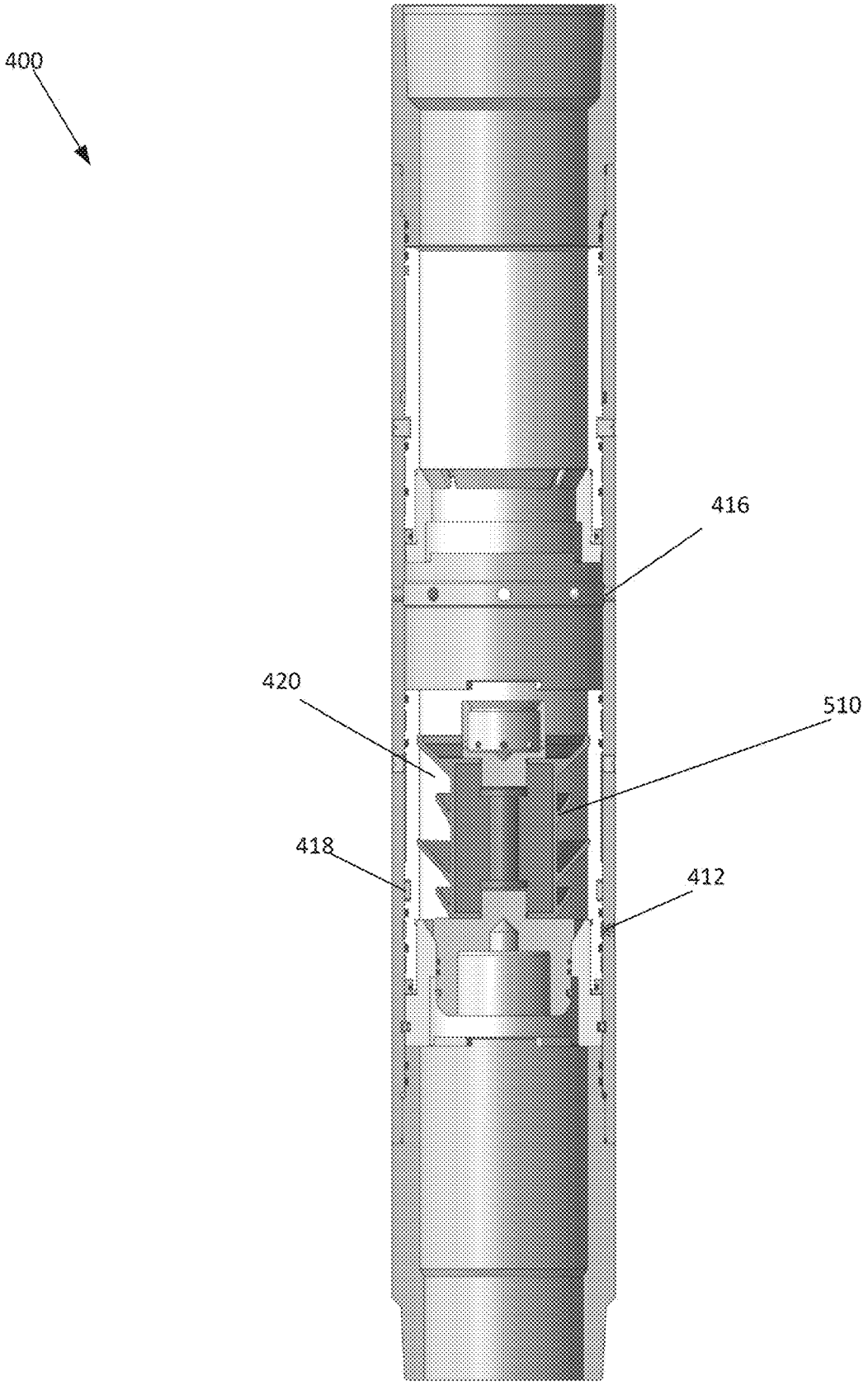
FIG. 5 depicts a sub positioned above a rotating tool, according to an embodiment.

FIG. 5 depicts a sub 400 positioned above a rotating tool 300, according to an embodiment. Elements depicted in FIG. 5 may be described above, and for the sake of brevity, a further description of these elements may be omitted.

After burst disc 414 ruptures and a first wiper 510 is pumped downhole, the first wiper 510 may land on first sleeve 420. When the first wiper 510 lands on the first sleeve 420, an area below the first wiper 510 may be isolated from an area above the first sleeve. This may allow pressure above first wiper 510 to increase past a first pressure threshold associated with first shear pin 418. Responsive to the pressure above first wiper 510 increasing past the first pressure threshold, first shear pin 418 may shear and first sleeve 420 may slide towards a distal end of sub 400, close burst disc port 412, and expose communication port 416.

When communication port 416 is exposed, sub 400 may rotate by receiving rotational forces from a rotating tool coupled to the distal end of sub 400. While rotating, cement may be pumped through sub 400 and enter an annulus through communication port 416. Cement may then circulate or be displaced at 6 bbls/min into the annulus while rotating at 20-30 rpm to uniformly displace the cement into the annulus. This may ensure annular cement well barrier element integrity when creating a zonal isolation barrier.

Figure 6:
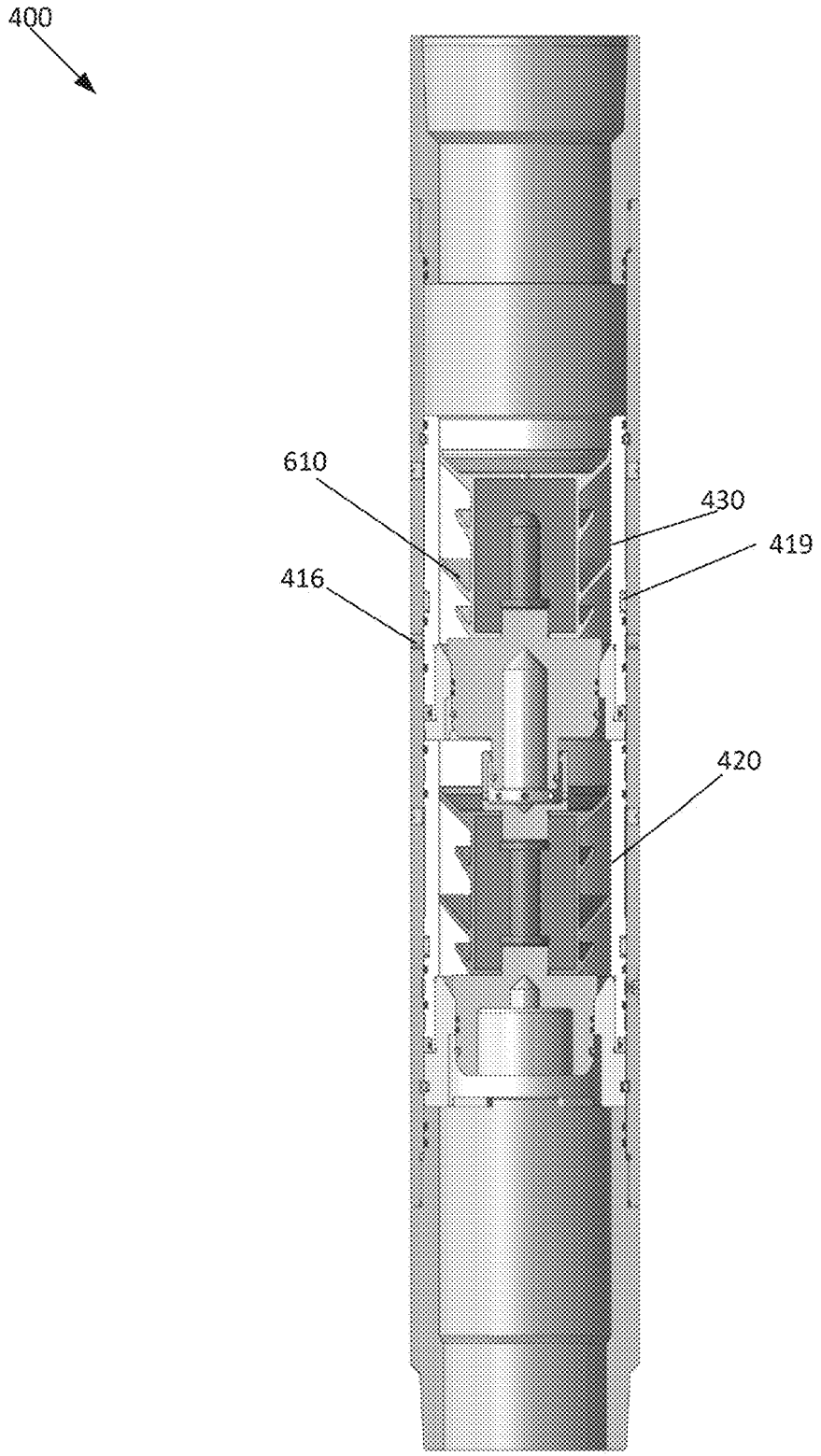
FIG. 6 depicts a sub positioned above a rotating tool, according to an embodiment.

FIG. 6 depicts a sub 400 positioned above a rotating tool 300, according to an embodiment. Elements depicted in FIG. 6 may be described above, and for the sake of brevity, a further description of these elements may be omitted.

After the cementing job is completed, the second wiper plug 610 may be pumped downhole while sub 400 continues to rotate. This may further ensure annular cement well barrier element integrity. Second wiper plug 610 may be pumped downhole until second wiper plug 610 lands on second sleeve 430, isolating an area above second wiper plug 610 and an area below second wiper plug 430. This isolation may allow pressure above the second wiper plug 610 to increase past a second pressure threshold to shear second shear pin 419.

Responsive to shearing second shear pin 419, second sleeve 430 may slide downhole to be positioned adjacent to a proximal end of first sleeve 420 and to cover communication port 416. Once the second sleeve 430 is locked in position, the rotating tool 300 may stop rotating, the casing string may hang off, and the upper part of the casing string above the rotating tool 300 may be pressure tested to verify integrity.

Figure 7:
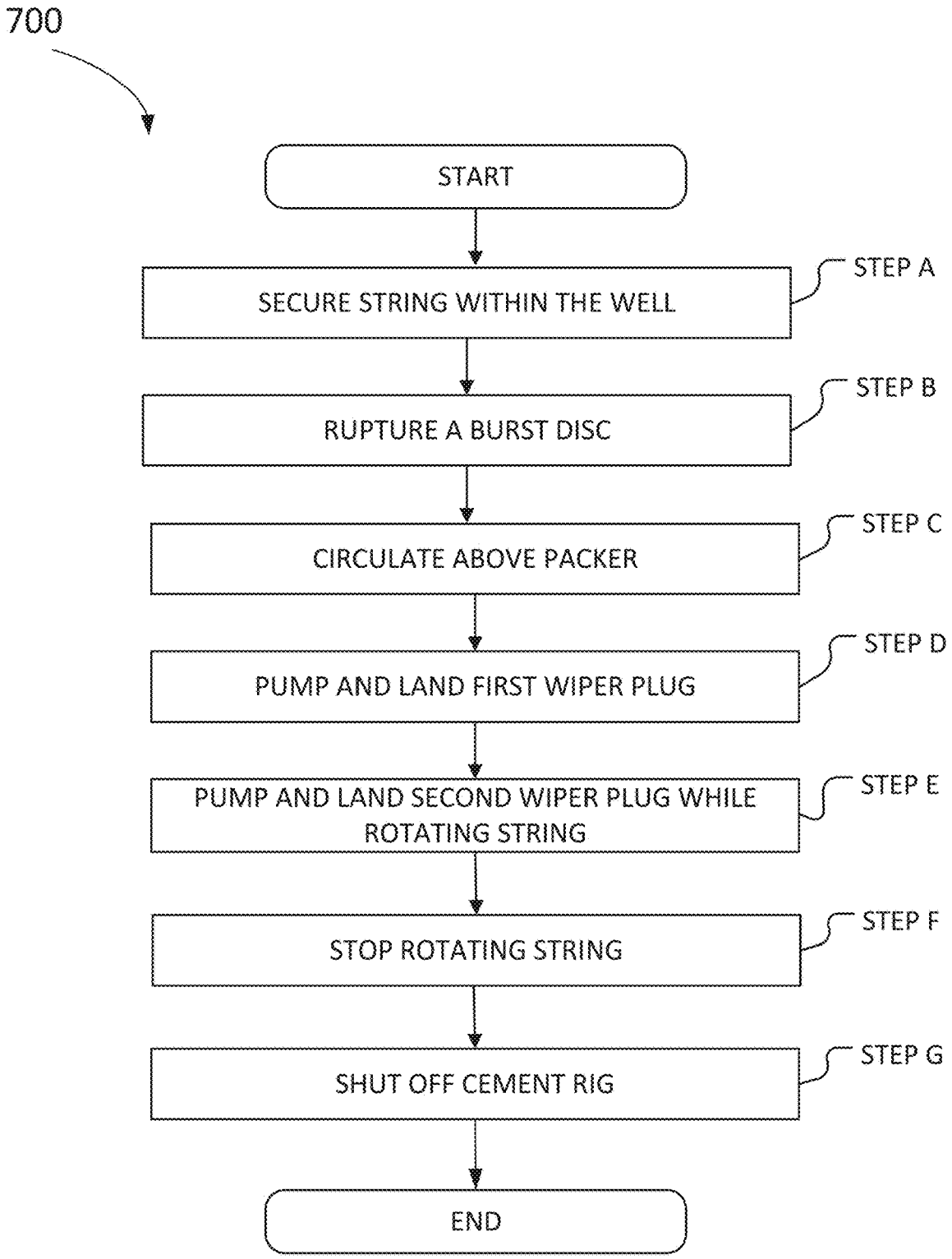
FIG. 7 depicts a method for ensuring annular cement well barrier element integrity when creating a zonal isolation barrier, according to an embodiment.

FIG. 7 depicts method 700 for ensuring annular cement well barrier element integrity when creating a zonal isolation barrier, according to an embodiment. The operations of the method presented below are intended to be illustrative. In some embodiments, the method may be accomplished with one or more additional operations not described, and/or without one or more of the operations discussed. Additionally, the order in which the operations of the method are illustrated in FIG. 7 and described below is not intended to be limiting. Furthermore, the operations of method 700 may be repeated for subsequent zones in a well.

At step A, after a top plug has landed on the first stage cement job, a string may be hung off in the wellhead, and the entire string may be pressurized to inflate a packer to secure the string within the well. Then, the pressure integrity of the string may be tested and the packer integrity may be tested as well.

At step B, the pressure within the casing may increase to rupture a burst disc within the string above the packer.

At step C, circulation above the packer may be established through a passageway that housed the burst disc.

At step D, a spacer may be pumped through the sub, and a first wiper plug may be released. Cement slurry can be mixed and pumped, displacing the first plug-down hole. The first wiper plug may be pumped downhole and land on a profile of a first sleeve, closing the passageway that housed the burst disc, sliding the first sleeve downward, sealing off the burst disc, and exposing the communication ports. In embodiments, the spacer may be configured to exit the sub through the passageway, and the cement will exit the sub through the communication port, wherein the sub rotates while circulating the cement.

At step E, after mixing and pumping of cement slurry is completed, a second wiper plug may be released while the sub is rotating. The second wiper plug may push the cement out of the rotating communication port while traveling toward the first wiper plug. Further, the second wiper plug may be configured to displace the cement with fluid while traveling downhole. The second wiper plug may land in a profile of the second sleeve, pressure above the second wiper plug may increase, and the second sleeve may travel downhole to close the communication port and lock the second sleeve into position. These processes may occur while the sub is rotating.

At step F, the rotation of the sub may cease. The casing string may be hung off, and the pressure integrity of the upper part of the casing above the packer may be verified.

At step G, the cement rig may be shut off at the surface.

Figure 8:
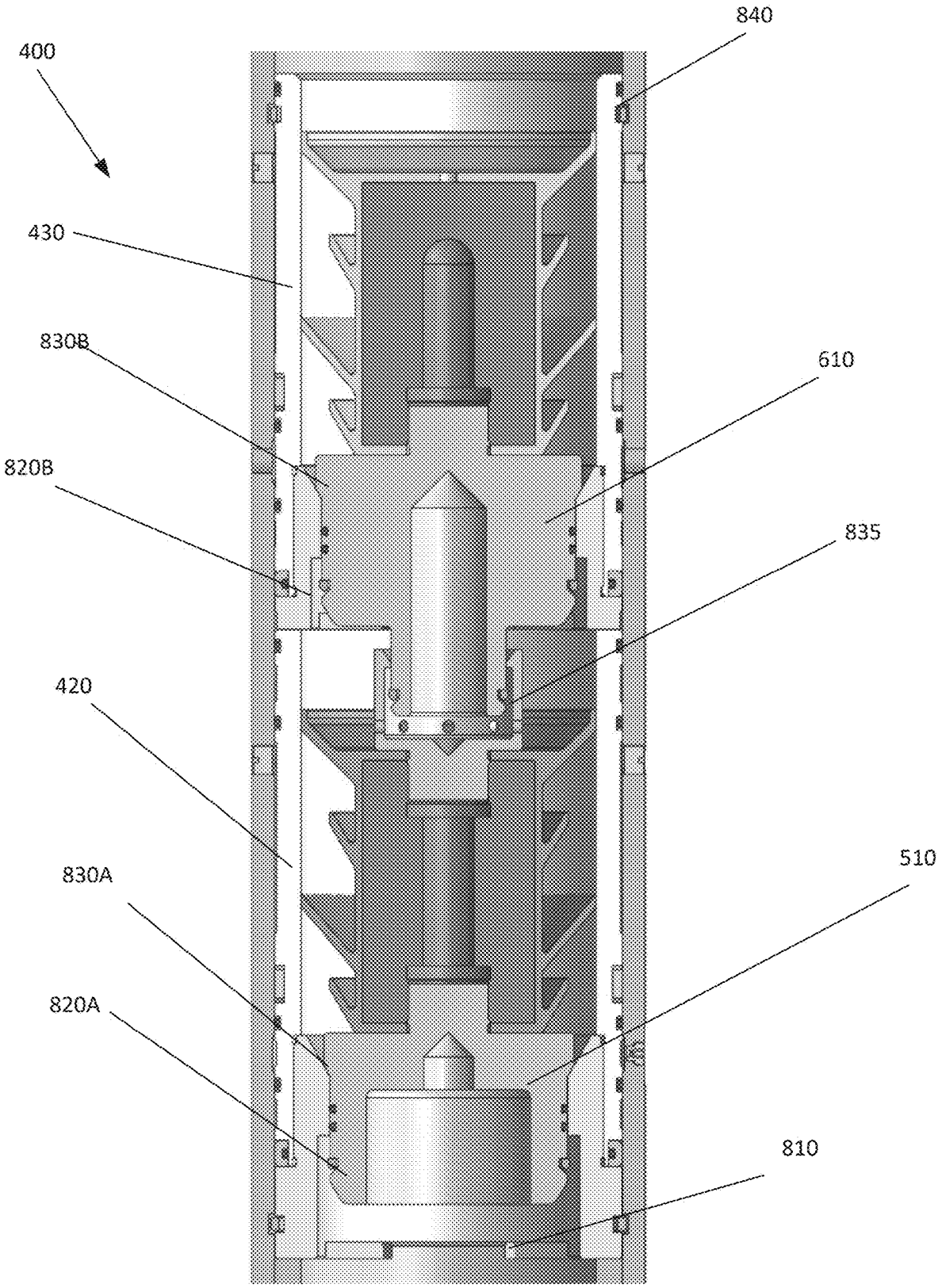
FIG. 8 depicts the sub, according to an embodiment.

FIG. 8 depicts sub 400, according to an embodiment. Elements depicted in FIG. 8 may be described above and for the sake of brevity; a further description of these elements may be omitted.

As depicted in FIG. 8, sub 400 may include a plurality of anti-rotation elements that are configured to rotationally lock sub 400, first sleeve 420, first wiper plug 510, second sleeve 430, and second wiper plug 610 together. To rotationally lock the elements together, the first sub 400 may include distal castling 810, first latching mechanism 820A, second latching mechanism 820B, first locking groove 830A, second locking groove 830B, plug couplers 835, and sub latch 840.

Distal castling 810 may be a series of alternating slots and fingers between a profile within sub 400 and a distal end of the first sleeve 420. In embodiments, the slots of sub 400 are configured to be aligned with the fingers of first sleeve 420, and the slots of first sleeve 420 are configured to align with the fingers of sub 400. Distal castling 810 may be configured to allow the linear movement of first sleeve 420 in a first direction, but not allow the rotational movement of first sleeve 420 responsive to aligning the slots and fingers of distal castling 810.

First latching mechanism 820A may be configured to relatively rotationally and linearly lock first sleeve 420 with first wiper plug 510. First latching mechanism 820A may include an indentation positioned on the nose of the first wiper plug 510 that is configured to receive a projection on an inner diameter of a distal end of first sleeve 420. Responsive to provisioning the projection within the indentation, all of the edges of the projection may be encompassed by the indentation.

The second latching mechanism 820B may be configured to relatively rotationally and linearly lock the second sleeve 430 with the second wiper plug 610. Second latching mechanism 820B may include an indentation positioned on the nose of second wiper plug 610 that is configured to receive a projection on an inner diameter of a distal end of second sleeve 430. Responsive to provisioning the projection within the indentation, all of the edges of the projection may be encompassed by the indentation.

Locking grooves 830A may be configured to relatively rotationally lock the first sleeve 420 with the first wiper plug 510. Locking grooves 830B may include an indentation positioned on the nose of the first wiper plug 510 that is configured to receive a projection on an inner diameter of the proximal end of first sleeve 420.

Locking grooves 830B may be configured to relatively rotationally lock the second sleeve 430 with the second wiper plug 610. Locking grooves 830B may include an indentation positioned on the nose of second wiper plug 610 that is configured to receive a projection on an inner diameter of a proximal end of second sleeve 430.

Plug couplers 835 may be configured to lock and latch the first wiper plug 510 and the second wiper plug together 610. Plug couplers 835 may include an expandable ring on the nose of the second wiper plug 610 and a latch on the inner diameter of the proximal end of the first wiper plug 510. The expandable ring may be configured to expand into a groove within the latch to lock the two wiper plugs together.

Sub latch 840 may include an indentation on a proximal end of the outer diameter of the second sleeve 430 that is configured to receive an expandable lock. Responsive to the indentation being aligned with the expandable lock, the expandable lock may have a second end extend into the indentation while the first end remains coupled to the inner diameter of sub 400. This may rotationally and linearly lock the second sleeve 430 with sub 400.

Figure 9:
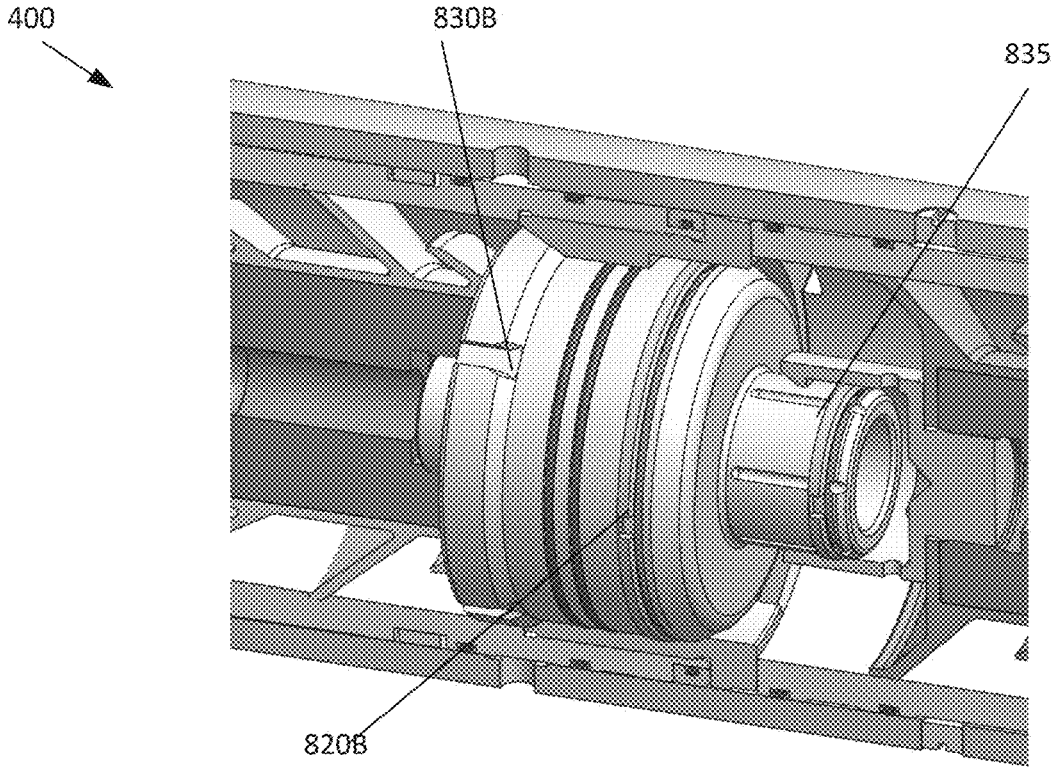
FIGS. 9 and 10 depict portions of a sub, according to an embodiment.
Figure 10:
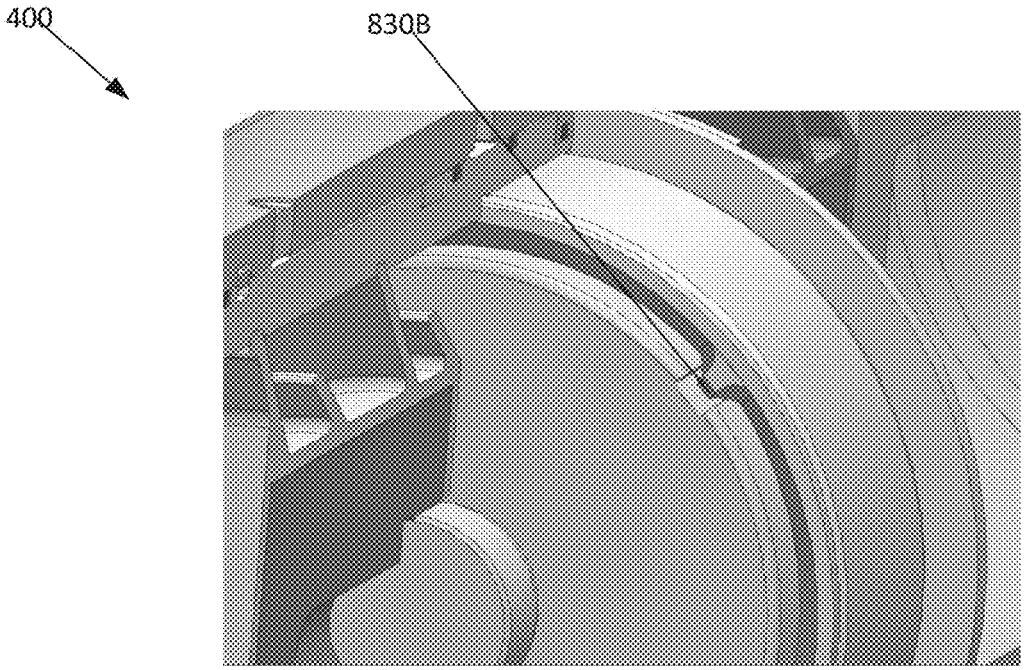

FIGS. 9 and 10 depict portions of sub 400, according to an embodiment. Elements depicted in FIGS. 9 and 10 may be described above, and for the sake of brevity, a further description of these elements may be omitted.

Figure 11:
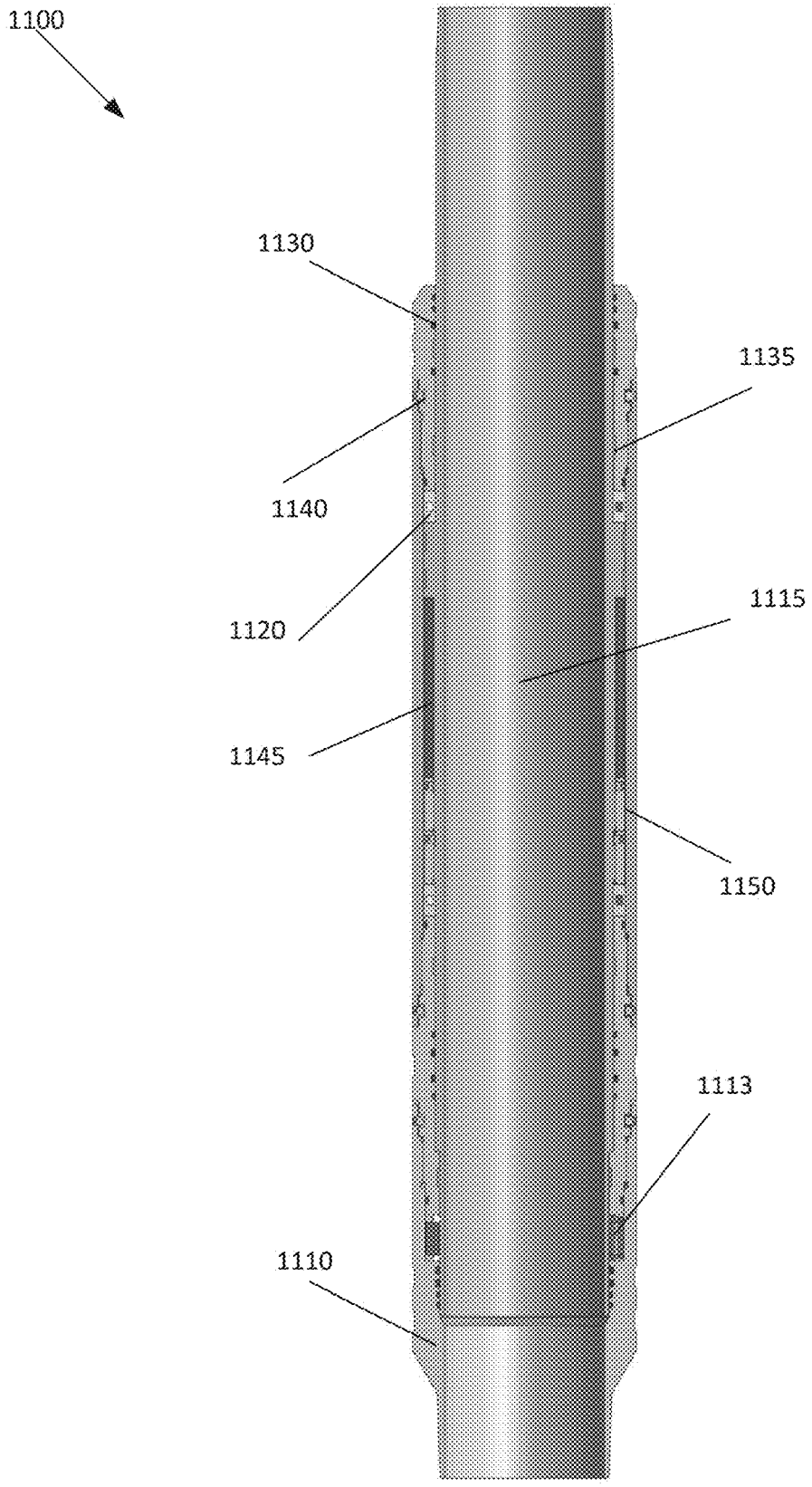
FIG. 11 depicts a rotating tool, according to an embodiment.

FIG. 11 depicts a rotating tool 1100, according to an embodiment. Elements depicted in FIG. 11 may be described above, and for the sake of brevity, a further description of these elements may be omitted.

Rotating tool 1100 may include an outer housing 1110, inner housing 1115, rotating element 1120, clutch 1113, seals 1130, rings 1135, set screws 1140, swellable element 1145, and threaded element nut and mandrel 1150.

The outer housing 1110 and inner housing 1115 may be tubular elements that are configured to selectively and relatively rotate. The outer housing 1110 and inner housing 1115 may be separated by rotating element 1120 and clutch 1113. Responsive to rotating inner housing 1115 in a first direction, clutch 1113 may not transfer rotational forces to outer housing 1110. Responsive to rotating inner housing 1115 in a second direction, clutch 1113 and rotating element 1112 may allow outer housing 1110 to rotate in the second direction. This rotating of outer housing 1110 may correspondingly rotate a string coupled to outer housing 1110, wherein the rotation of the string coupled to outer housing 1110 may be in a position within the wellbore close to a cementing job.

Bearings 1120 may be positioned between outer housing 1110 and inner housing 1115, and may be high tensile rated axial bearings set up in tandem to evenly distribute a rotational load.

Seals 1130 may be positioned between outer housing 1110 and inner housing 1115 to prevent unwanted fluid, gas, pressure mitigation, etc. during run-in or during operation.

Rings 1135 may be rings that are positioned between outer housing 1110 and inner housing 1115 and are configured to aid rotating tool 1100 during operation to maintain all components properly aligned and reduce rotational friction. This may allow for prolonged use of rotating tool 1100 during the cementing process.

Set screws 1140 may be configured to couple inner housing 1115 and outer housing 1110, and be configured to prevent threaded connections from backing off during cementing.

Swellable element 1145 may be positioned between outer housing 1110 and inner housing 1115 and may be an expandable element that is configured to expand after a cementing operation. The swellable elements may prevent any long-term pressure migration into the inner housing's 1115 inner diameter.

Threaded element nut and mandrel 1150 may be configured to act as a backup jam nut or stop to prevent the mandrel nut from shifting into the swellable element during operation. The mandrel nut may be configured to allow proper pre-loading on bearings 1120 and to assist with distributing the load evenly between both bearings 1120 while keeping the mandrel concentric.

Figure 12:
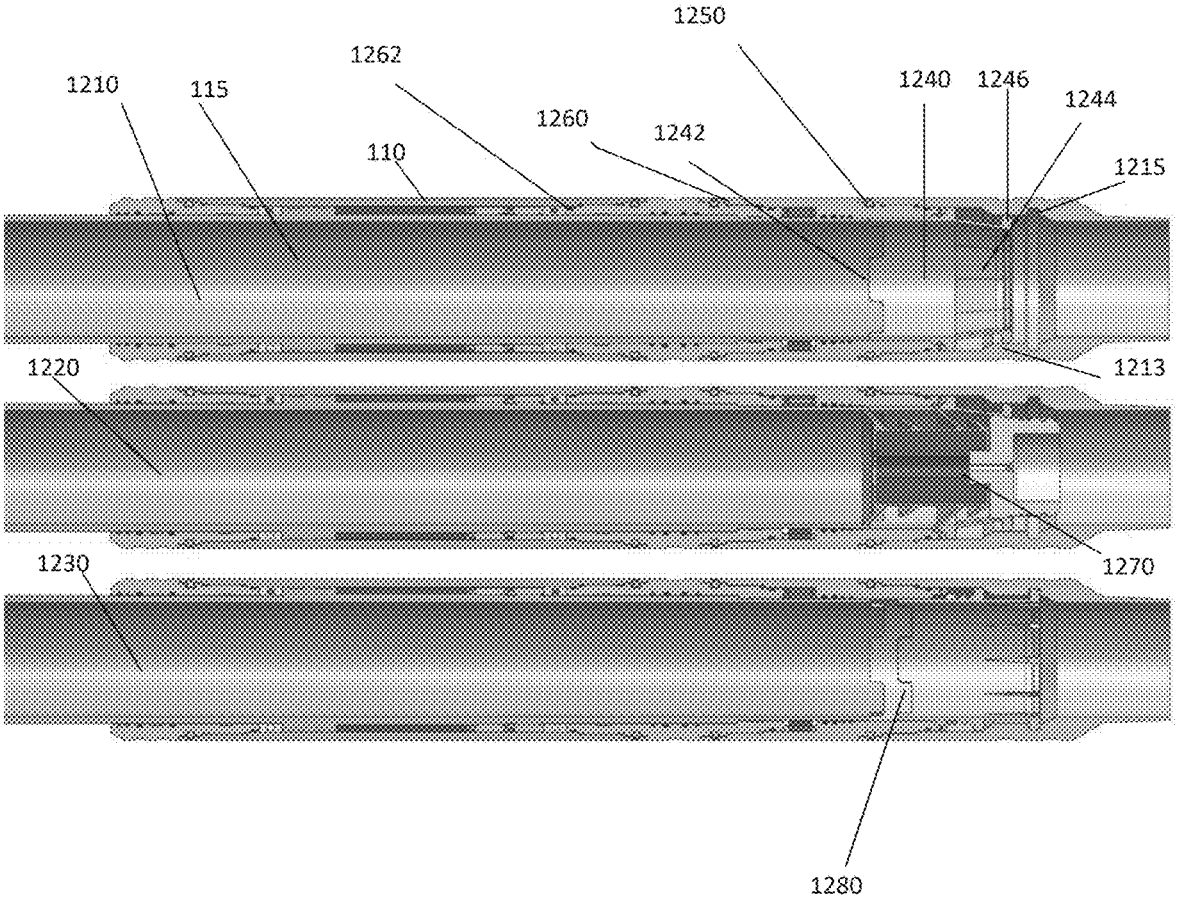
FIG. 12 depicts a rotating tool with an anti-rotation collet coupled to a distal end of an inner housing, according to an embodiment.

FIG. 12 depicts a rotating tool with an anti-rotation collet 1240 coupled to a distal end of an inner housing 115, according to an embodiment. Furthermore, FIG. 12 depicts three stages 1210, 1220, 1230 associated with operating the anti-rotation collet 1240. Elements depicted in FIG. 12 may be described above, and for the sake of brevity, a further description of these elements may be omitted.

Anti-rotation collet 1240 may be positioned on a distal end of the inner housing 115, and be encompassed by the outer housing 110. When run in a hole, anti-rotation collet 1240 may be coupled to outer housing 110 via shear screws 1250 that are configured to break responsive to pressure being applied to shear screws 1250 being above a pressure threshold. When shear screws 1250 are intact anti-rotation collet 1240 may not slide or move relative to outer housing 110 and/or inner housing 115. Furthermore, when anti-rotation collet 1240 is coupled to outer housing 110, inner housing 115 nor outer housing 110 may rotate relative to one another. Responsive to shear screws 1250 breaking, anti-rotation collet 1240, anti-rotation collet 1240 may slide towards the distal end of outer housing 110 creating space between the proximal end of anti-rotation collet 1240 and the distal end of inner housing 115. This may enable the free rotation of inner housing 110 relative to outer housing 110.

Anti-rotation collet 1240 may include castling 1242, fingers 1244, and projection 1246.

Castling 1242 may be a series of abutments and indentations that are configured to interface with reciprocal indentations and abutments on the distal end of the inner housing 115. When castling 1242 is interfaced with inner housing 115, the mandrel can handle high torque forces during tool run-in. However, after castling is disengaged from inner housing 115 after anti-rotation collet 1240 has shifting open, and inner housing 115 may freely rotate.

Fingers 1244 may be positioned on a distal end of anti-rotation collet 1240. Fingers 1244 may be configured to radially expand, such that the outer diameter of fingers 1244 may be substantially the same as the inner diameter of a portion of the profile of outer housing 110 that is aligned with the outer diameter of fingers 1244. Accordingly, if bump 1213 on the inner diameter of outer housing 110 has a first inner diameter, and groove 1215 on the inner diameter of outer 110 has a second inner diameter, when fingers 1244 are aligned with bump 1213 fingers 1244 may have a first inner diameter and when aligned with the groove 1213 fingers 1244 may have a second inner diameter. This may allow fingers 1244 to restrict the inner diameter across outer housing 110 before activation while matching the full bore inner diameter when activated.

Projection 1246 may be positioned on an outer diameter of fingers 1244, and be configured to be positioned adjacent to the inner diameter of outer housing 110. When run in a hole, projection 1246 may be positioned adjacent to bump 1270. Responsive to breaking shear screws 1250, projection 1246 may slide downhole to be positioned within groove 1215. This may cause anti-rotation collet 1240 to be latched into outer housing 110, limiting the relative linear movement of anti-rotation collet 1240 with outer housing and opening the collet fingers.

Furthermore, outer housing 110 may include different shoulder profiles 1260, and 1262, which may prevent any premature collet shifting during run-in before shear screws 1250 break.

At operation 1220, once the rotating tool is positioned at a desired depth, a wiper plug 1270 may be pumped downhole. Wiper plug 1270 may land on anti-rotation collet 1240, and shear the shear screws 1250.

At operation 1230, after the shear screws 1250 are sheared, the anti-rotation collet 1240 may be activated, increasing the inner diameter across fingers 1240 and allowing wiper plug 1270 to move downhole. Furthermore, after anti-rotation, collet 1240 moves downhole projection 1260 may be latched into grooves 1215. This may create a space 1280 between collet 1280 and inner housing 115, allowing inner housing 115 to freely and independently rotate.

Figure 13:
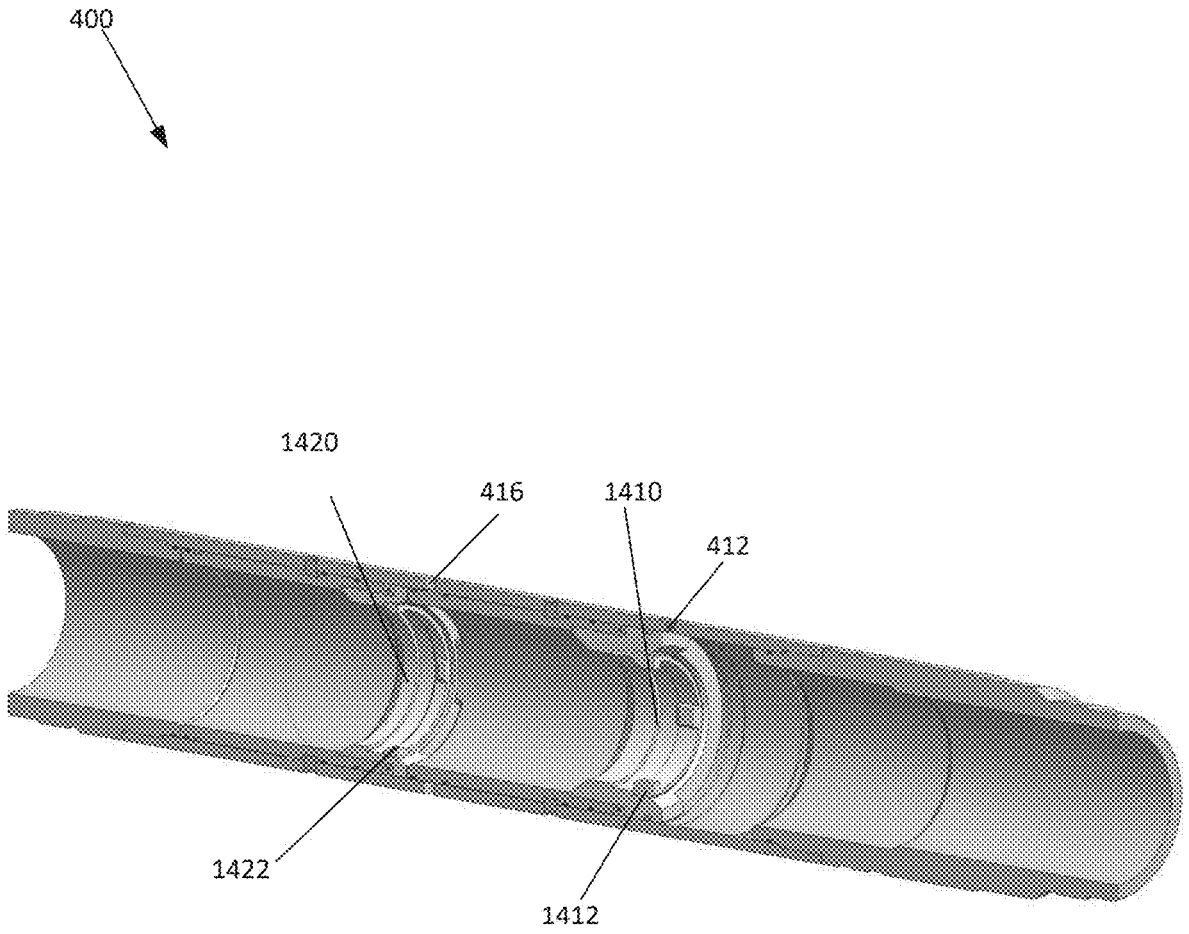
FIG. 13 depicts a sub, according to an embodiment.

FIG. 13 depicts sub 400, according to an embodiment. Elements depicted in FIG. 13 may be described above, and for the sake of brevity, a further description of these elements may be omitted.

As depicted in FIG. 13 sub 400 may include a first insert 1410 configured to receive a first wiper plug, and a second insert 1420 configured to receive a second wiper plug. First insert 1410 may include first anti-rotation projections 1412, and second insert 1420 may include second anti-rotation projections 122. The anti-rotation projections 1412, 1422 are configured to be interfaced with grooves on the nose of the corresponding wiper plug, which may assist in limiting the relative rotations of the wiper plugs and inner housing if milling is required.

Furthermore, the first insert 1410 and second insert 1410 may include tapered profiles, which may correspond with the tapering of the outer diameter of the wiper plugs. Once a corresponding wiper plug lands on a corresponding insert, the tapered profile may create a friction lock fit and a metal-to-metal sealing surface. This friction fit may prevent the plug nose from backing out linearly, and prevent rotation during a milling operation.

Figure 14:
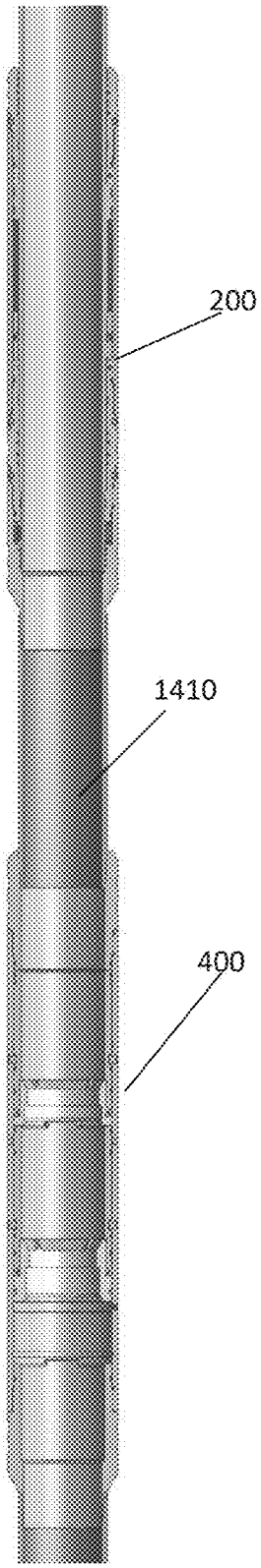
FIGS. 14-16 depict a rotating tool coupled to a sub via a casing string, according to an embodiment.
Figure 15:
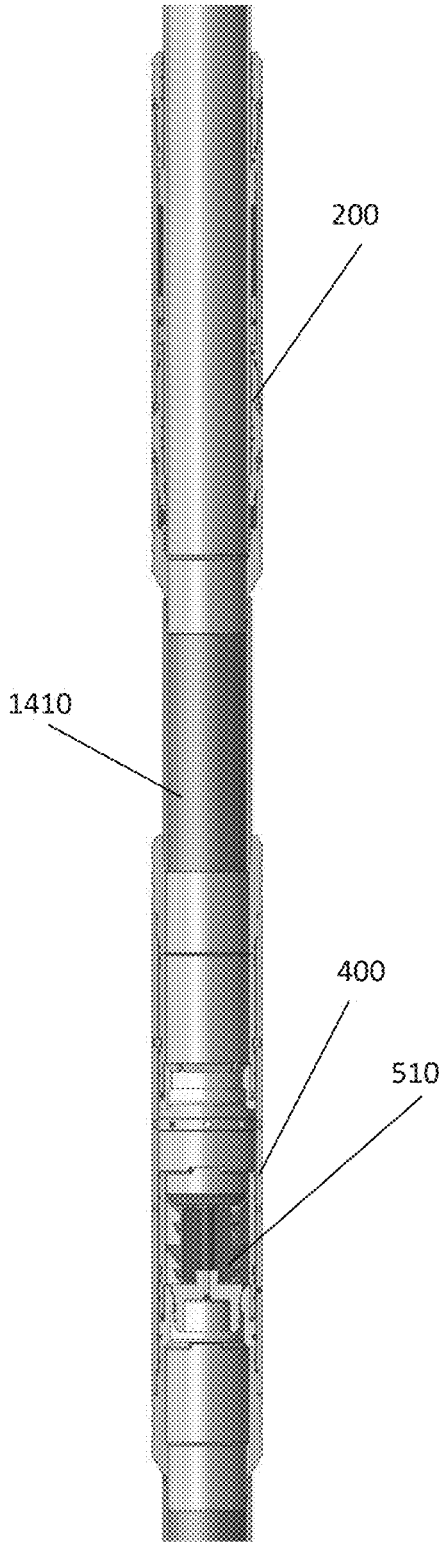
Figure 16:
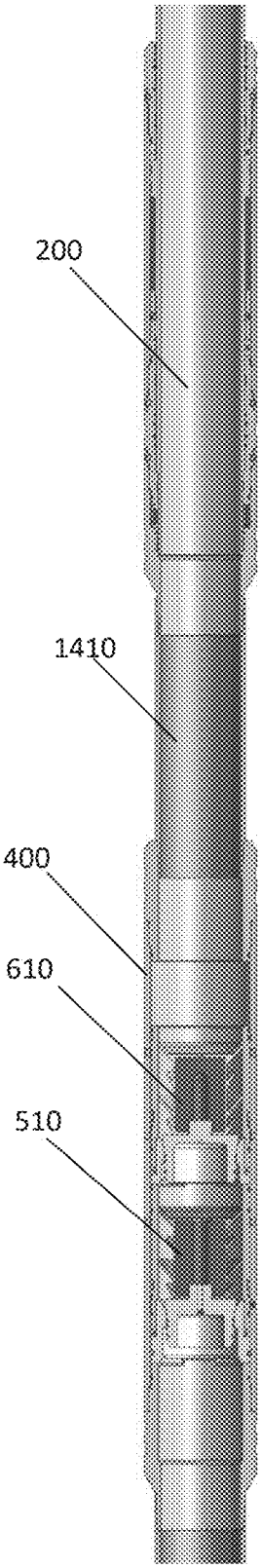

FIGS. 14-16 depicts a rotation tool 200 coupled to a sub 400 via a casing string 1410, according to an embodiment. Elements depicted in FIGS. 14-16 may be described above, and for the sake of brevity, a further description of these elements may be omitted.

As depicted in FIGS. 14-16 a casing string 1410 may couple rotating tool 200 and sub 400. Responsive to turning rotating tool 200 in a second direction, outer housing 110 may turn casing string 1410, which may in turn rotate sub 400.

Figure 17:
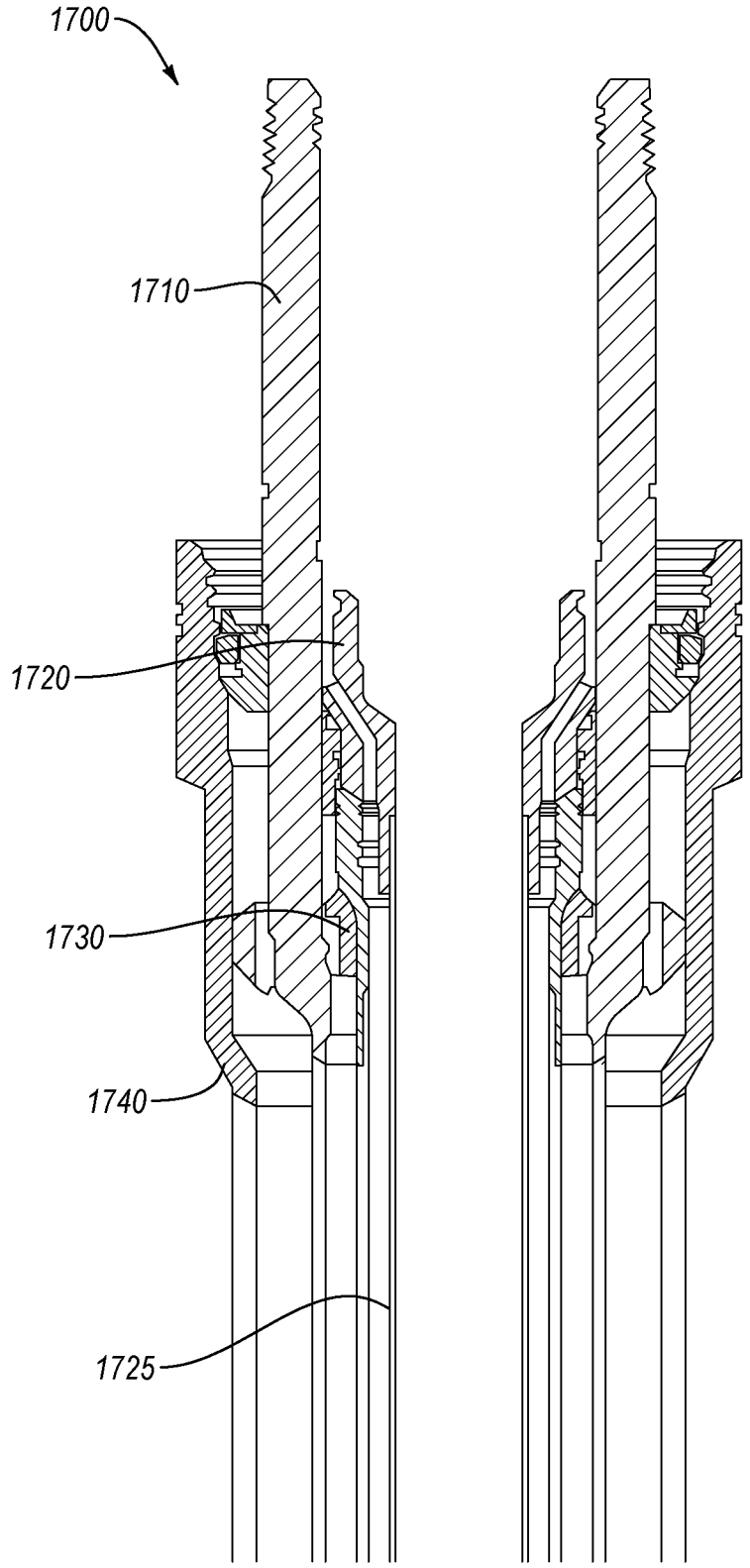
FIG. 17 depicts a wellhead with a seal bore, according to an embodiment.

FIG. 17 depicts a seal assembly 1720 positioned within a wellhead 1710, according to an embodiment. Seal assembly 1720 may be configured to be positioned on a seat 1730 with the wellhead 1710 when seal assembly 1720 is not rotated, and seal assembly 1720 may be positioned above and outside of wellhead 1710 when it is desirable to rotate seal assembly 1720 to correspondingly rotate rotating tool 210.

Wellhead 1710 may be a component at the surface of an oil or gas well that provides the structural and pressure-containing interface for drilling and production equipment. Wellhead 1710 may include conductor 1740 and seat 1730. Conductor 1740 may be the first string of casing, which may have the largest diameter of casing to be installed in a well. In embodiments, a proximal end of conductor 1740 may be positioned above the surface of the well, and a distal end of conductor 1740 may be positioned downhole. Seat 1730 may be positioned within an inner diameter of wellhead 1710, and may be configured to receive seal assembly 1720. Accordingly, seat 1730 may limit the downhole movement of seal assembly 1720.

Seal assembly 1720 may be a system of seals arranged on an outer diameter of seal assembly 1720 to engage in an inner diameter of wellhead 1710 to isolate the production-tubing conduit from the annulus. In embodiments, seal assembly 1720 may be configured to rotate when it is not positioned within wellhead 1710 and may be configured to be rotationally locked when positioned on seat 1730. By rotationally locking seal assembly 1720 when positioned within wellhead 1710, the seals within the annulus may not be eroded. Casing 1725 may be coupled to a seal assembly 1720 and may run downhole until a stroke tool 1900 (shown in FIGS. 19-21).

FIG. 17 depicts a seal assembly 1720 positioned outside wellhead 1710, according to an embodiment.

In implementations seal assembly 1720 may be positioned on seat 1730 during an initial, first-stage cement job. After completing the first stage, it may be desirable to evenly disperse the cement during the second stage. During the second stage, and after a downhole packer has been extended across the annulus to lock the downhole tool in place, a downhole stroke tool may be extended, allowing seal assembly 1720 to be lifted outside of wellhead 1710. Once seal assembly 1720 is positioned outside of wellhead 1710, seal assembly 1720 may be rotated to rotate casing 1725, which may correspondingly rotate the rotating tool 200 downhole. In embodiments, the stroke tool may be positioned between the seal assembly and the downhole rotating tool 200.

After the cementing operation, the stroke tool seal assembly 1720 may be repositioned on seat 1730, and the stroke tool may return to its original length.

Figure 18:
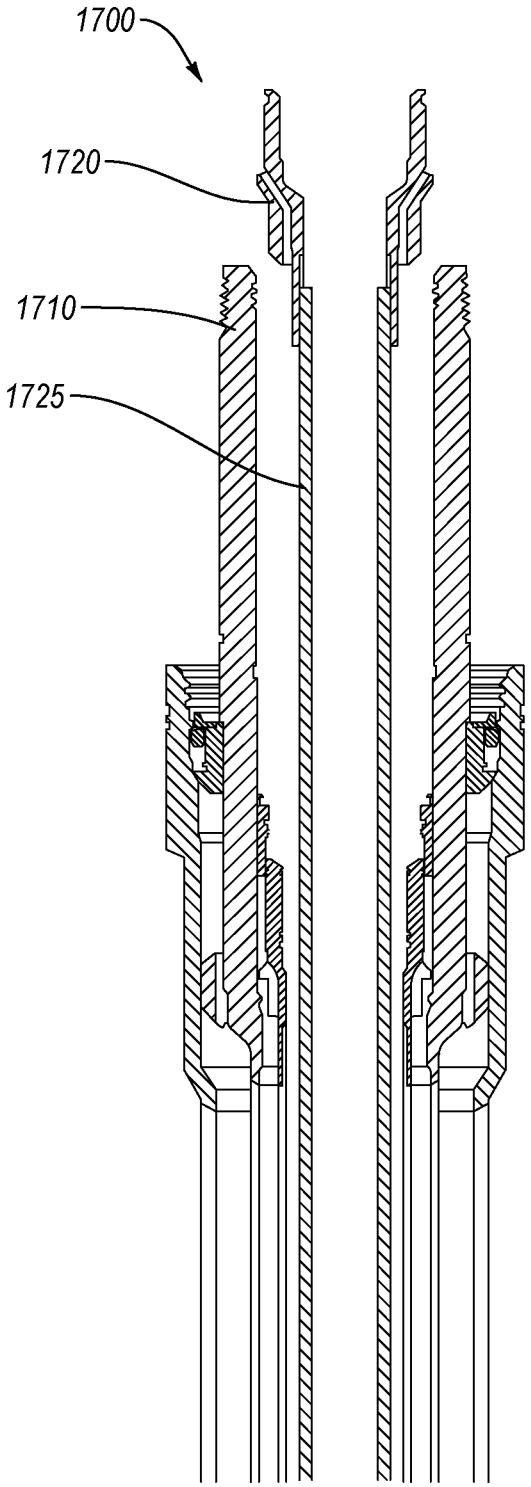
FIG. 18 depicts a wellhead with a seal bore, according to an embodiment.
Figure 19:
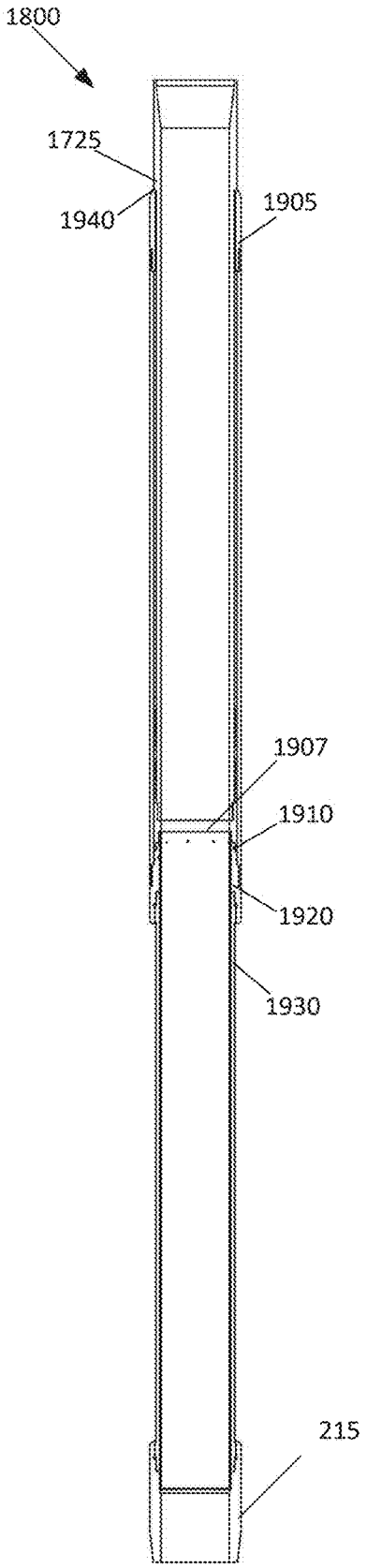
FIGS. 19-22 depict a stroke tool used in combination with a rotating tool, according to an embodiment.
Figure 20:
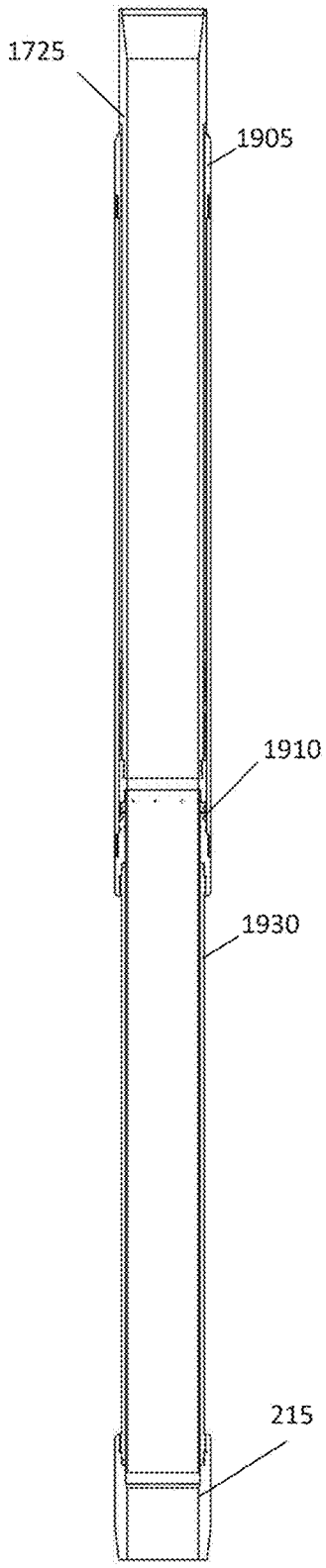

FIGS. 18-20 depict an operation sequence of a stroke tool 1800, according to an embodiment. In implementations, casing 1725 may run from seal assembly 1720 downhole to a first coupler joint 1907.

The first coupler joint 1907 may have a proximal inner diameter that is coupled to an outer diameter of the distal end of casing 1725. A distal inner diameter of the first coupler joint 1907 may be temporarily coupled to an outer diameter of a proximal end of the second coupler joint 1920 via a shear pin, or any other temporary coupling mechanism.

The second coupler joint 1920 may have an outer diameter that is coupled to a distal end of the stroking sleeve 1905 and an inner diameter that is coupled to an outer diameter of tubing 1920. In implementations, tubing 1920 may be coupled to the inner housing 215 of the rotating tool 200. In other embodiments, tubing 1920 may be the inner housing 215 of the rotating tool 200.

In embodiments, each of the elements of stroke tool 1800 may be rotationally locked with each other, such that rotation of casing 1725 may cause the rotation of tubing 1920.

As depicted in FIG. 19, when run-in hole temporary coupling mechanism 1920 may be intact. This may indirectly couple casing 1725 with stroking sleeve 1905. More so, when temporary coupling mechanism 1920 is intact, a proximal end of stroking sleeve 1905 may abut a ledge within an outer diameter of casing 1725, such that there is no relative movement along a longitudinal axis between stroking sleeve 1905 and casing 1725. This may allow a fixed distance via casing 1930 between the stroking sleeve 1905 and inner housing 215.

Responsive to an upward force or hydraulic force being applied to casing 1725, as depicted in FIG. 20, the temporary coupling mechanism 1920 may shear. The shearing of temporary coupling mechanism 1920 may allow for casing 1725 to move uphole along the longitudinal axis, while casing 1930 remains stationary, which may allow seal assembly 1720 to be pulled out of the wellhead 1710.

Figure 21:
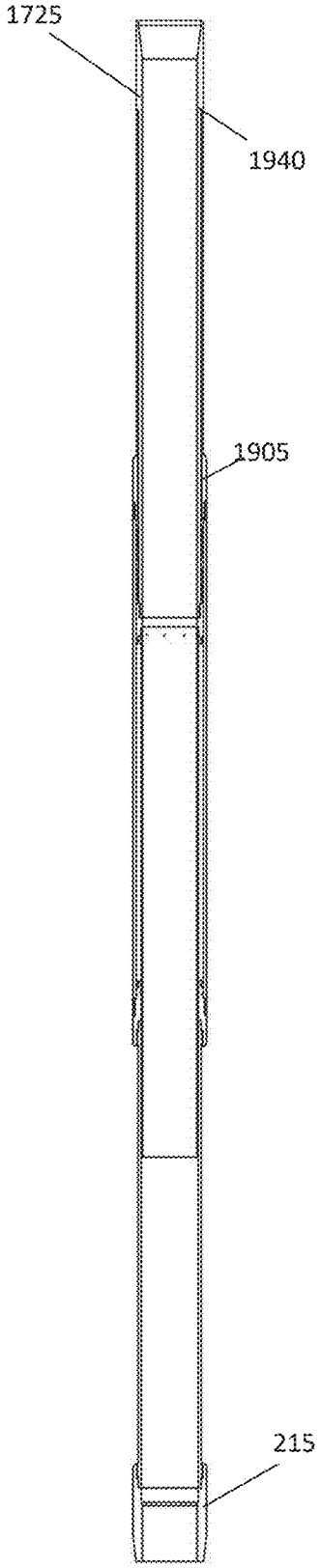

As depicted in FIG. 21, casing 1725 may be brought uphole a stroke length, which may increase the distance from ledge 1940 to the proximal end of the stroking sleeve 1905. Responsive to ending a casing operation that requires rotating stroke tool 1800, casing 1725 may be lowered downhole to once again minimize the distance between the ledge and the proximal end of the stroking sleeve 1905.

Figure 22:
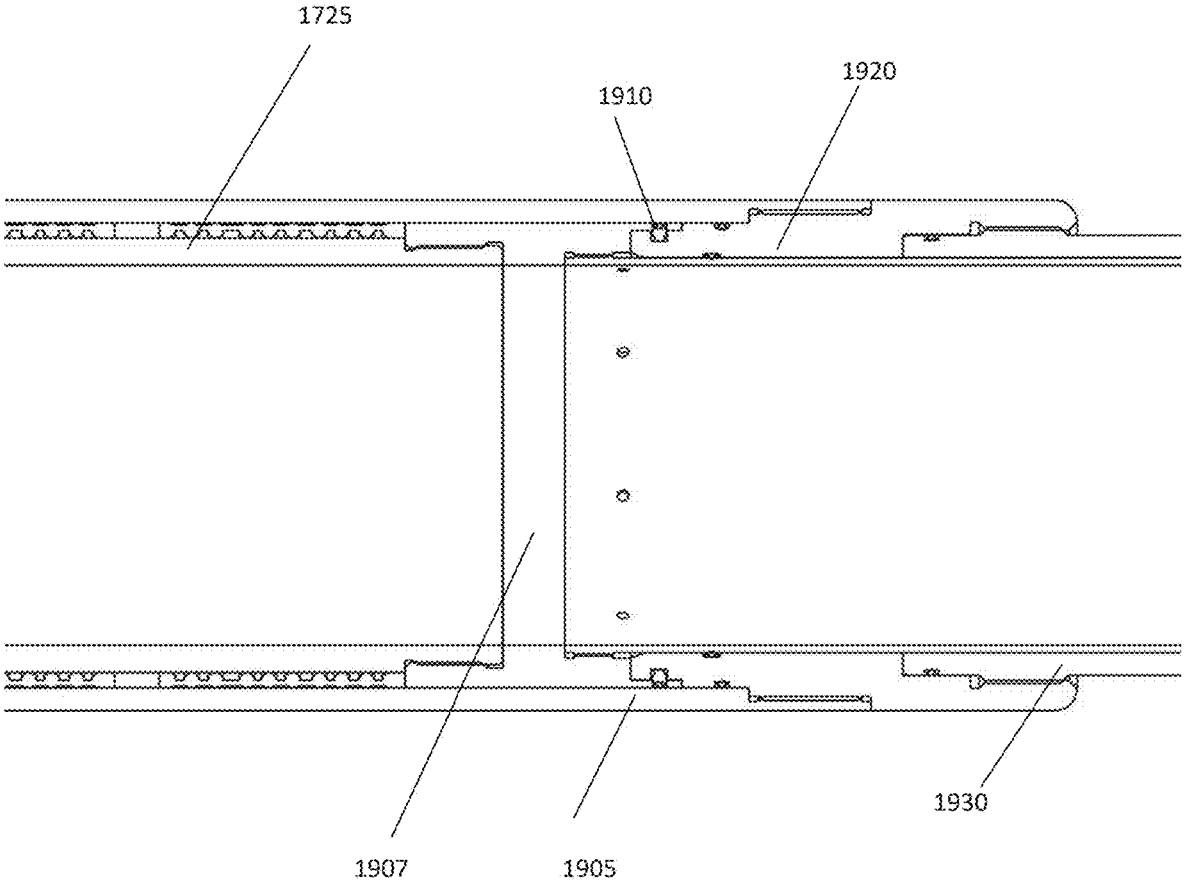

FIG. 22 depicts a detailed view of the first coupling joint 1907 and the second coupling joint 1920 while the temporary coupling mechanism 1910 is still intact, according to an embodiment. Elements depicted in FIG. 22 may be described above, and for the sake of brevity, a further description of these elements may be omitted.

Figure 23:
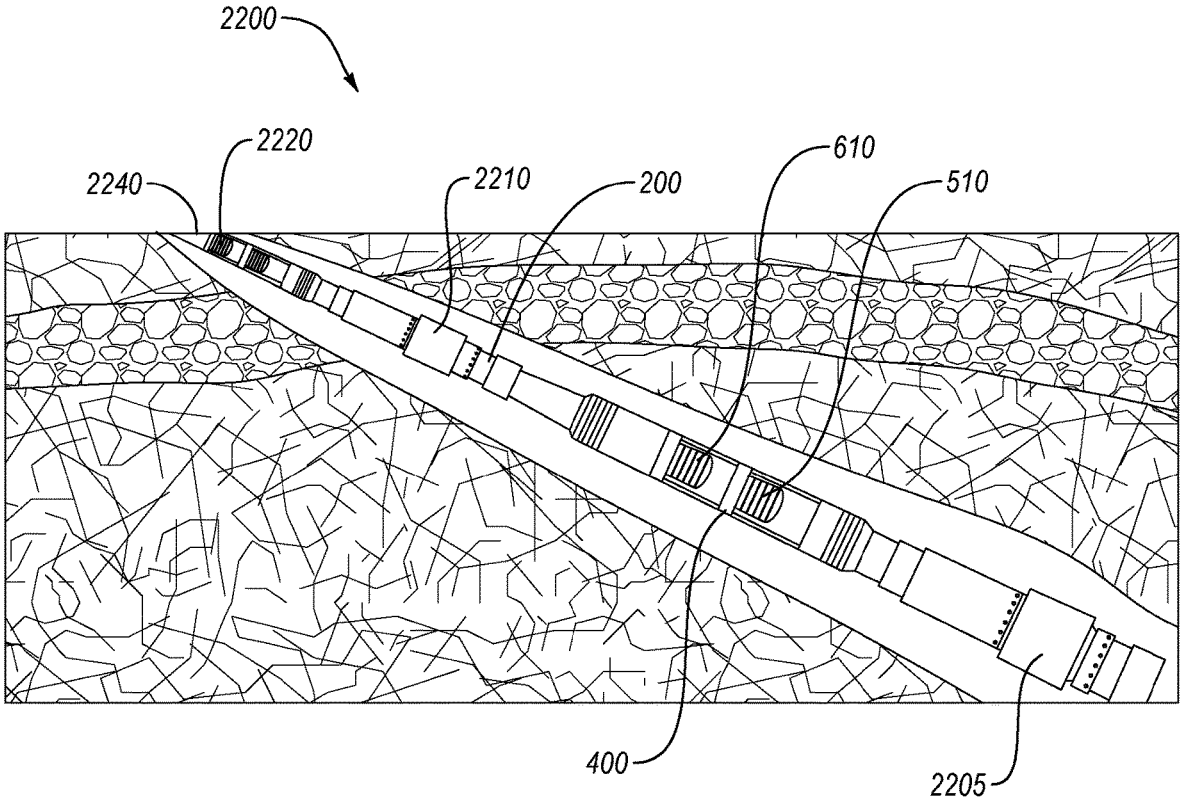
FIG. 23 depicts multiple subs with separate rotating tools, according to an embodiment.

FIG. 23 depicts multiple rotating tools 2240, 200 positioned in series, according to an embodiment. Elements depicted in FIG. 23 may be described above, and for the sake of brevity, a further description of these elements may be omitted.

In implementations, in the first stage, after a first top plug has landed on the first stage cement job, a string may be hung off in the wellhead, the seal assembly may be pulled out of the wellhead utilizing a stroke tool, and the entire string may be pressurized to inflate a first packer 2205 to secure the string within the well. Then, pressure within the casing may increase to rupture a first burst disc within the string above the first packer 2205, and circulation above the first packer 2205 may be established through a first passageway that housed the first burst disc. Subsequently, a first spacer may be pumped through the first sub, and a first wiper plug 510 may be released. Cement slurry can be mixed and pumped, displacing the first plug 510 downhole. The first wiper plug 510 may be pumped downhole and land on a profile of a first sleeve, closing the passageway that housed the first burst disc, sliding the first sleeve downward, scaling off the burst disc, and exposing the first communication ports. In embodiments, the spacer may be configured to exit the sub through the passageway, and the cement will exit the sub through the communication port, wherein the sub rotates while circulating the cement.

After mixing and pumping of cement slurry is completed, a second wiper plug 610 may be released while the sub is rotating via the first rotating tool 200. The second wiper plug 610 may push the cement out of the rotating communication port while traveling towards the first wiper plug 510. Further, the second wiper plug 610 may be configured to displace the cement with fluid while traveling downhole. The second wiper plug 610 may land in a profile of the second sleeve, pressure above the second wiper plug 610 may increase, and the second sleeve 610 may travel downhole to close the communication port and lock second sleeve into position. These processes may occur while the first sub is rotating via the first rotating tool 200.

In embodiments, the first rotating tool 200 may receive rotational forces from a second sub positioned directly above the first sub, wherein the second sub may include a second rotating tool 2240. The second rotating tool 2240 may be substantially the same as the first rotating tool 200, and for the sake of brevity, a further description may be omitted.

In implementations, after the first stage, after a second top plug has landed on the first stage cement job, the string may be once again hung off in the wellhead, and the seal assembly may again be pulled out of the wellhead utilizing the same stroke tool, and the entire string may be pressurized to inflate a second packer 2240 to secure the string within the well. Then, pressure within the casing may increase to rupture a second burst disc within the string above the second packer 2240, and circulation above the second packer 2240 may be established through a first passageway that housed the first burst disc. Subsequently, a second spacer may be pumped through the first sub, and a third wiper plug 2230 may be released. Cement slurry can be mixed and pumped, displacing the third wiper plug 2230 downhole. The third wiper plug 2230 may be pumped downhole and land on a profile of a second sleeve, closing the passageway that housed the second burst disc, sliding the second sleeve downward, sealing off the burst disc, and exposing the second communication ports. In embodiments, the second spacer may be configured to exit the second sub through the passageway, and the cement will exit the sub through the second communication port, wherein the second rotating tool 2240 rotates while circulating the cement. In embodiments, the first rotating tool 200 may not rotate while the second rotating tool 2240 rotates due to being cemented in place.

After mixing and pumping of cement slurry is completed, a fourth wiper plug 220 may be released while the sub is rotating via the second rotating tool 240. The fourth wiper plug 220 may push the cement out of the rotating communication port while traveling towards the third wiper plug 2230. Further, the fourth wiper plug 220 may be configured to displace the cement with fluid while traveling downhole. The fourth wiper plug 220 may land in a profile of the fourth sleeve, pressure above the fourth wiper plug 220 610 may increase, and the fourth wiper plug 220 may travel downhole to close the second communication port and lock the fourth sleeve into position.

Utilizing a first rotating tool 200 and a second rotating tool 2240, the liner may be cemented in multiple stages in the case of losses.

Figure 24:
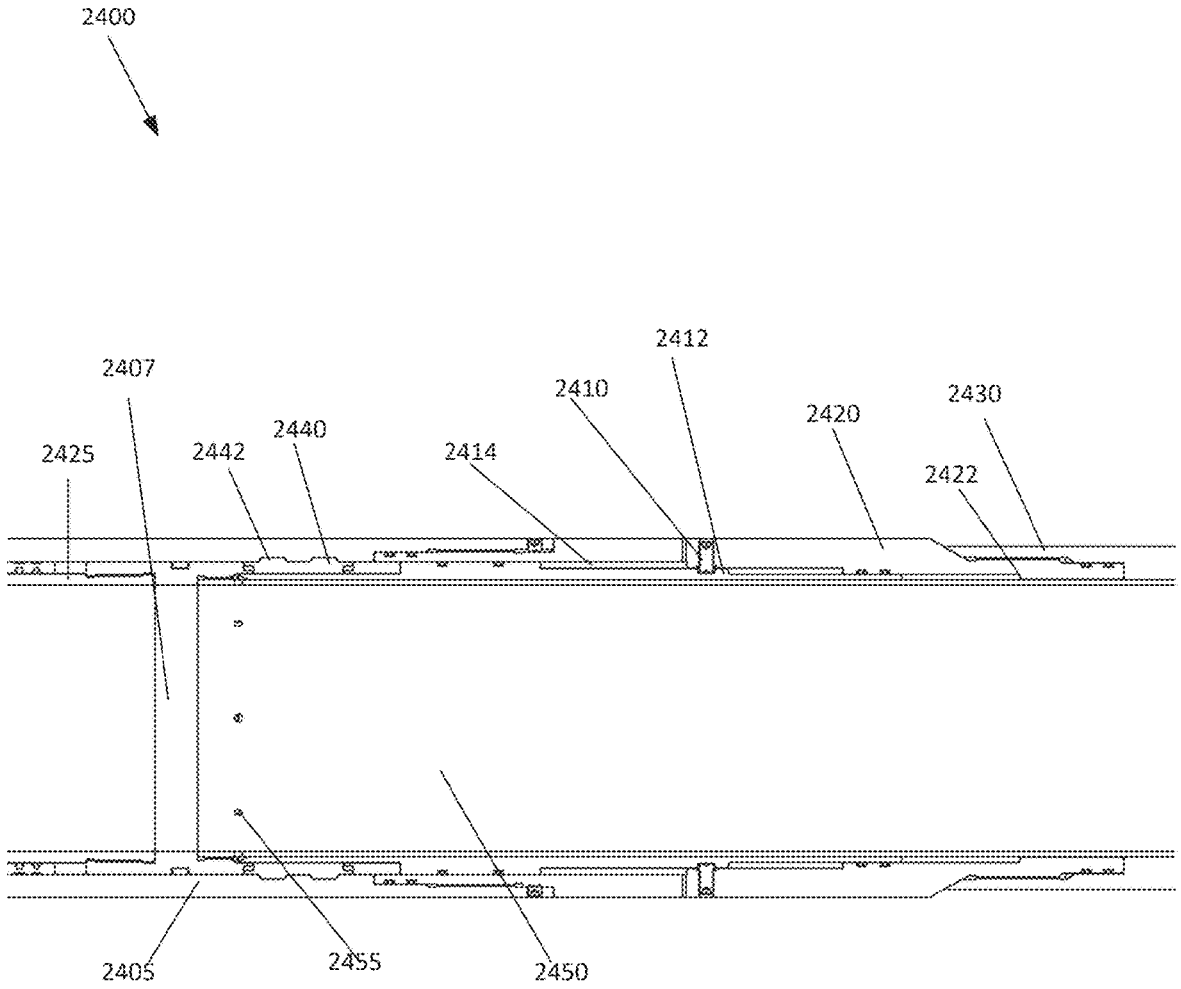
FIGS. 24-27 depict a stroke tool used in combination with a rotating tool, according to an embodiment.

FIG. 24 depicts a detailed view of stroke tool 2400, according to an embodiment. Elements depicted in FIG. 24 may be described above, and for the sake of brevity, a further description of these elements may be omitted. Stroke tool 2400 may be utilized during a cementing operation or any other downhole operation.

Stroke tool 2400 may include uphole casing 2425, first coupling joint 2407, stroke tool 2405, sliding sleeve 2412, second coupling joint 2420, downhole casing 2430, and inner sleeve 2450.

In embodiments, the temporary coupling mechanism 2410 may be configured to selectively couple second coupling joint 2420 and sliding sleeve 2142 together. When coupled together, an outer diameter of sliding sleeve 2142 may radially retain dogs 2440 between sliding sleeve 2142 and stroke tool 2405. Specifically, dogs 2440 may have outcrops that are configured to be positioned within recesses 2442 on the inner diameter of stroke tool 2405. Due to this relative positioning, dogs 2440 may axially lock stroke tool 2405 in place, such that stroke tool 2405 may not axially move relative to the other elements. After temporary coupling mechanism 2410 is sheared or otherwise broken, sliding sleeve 2412 may slide downhole to no longer axially aligned with dogs 2440. This relative movement may allow dogs 2440 to radially slide inward out of recesses 2442 to allow the axial movement between stroke tool 2405 and downhole casing 2430.

Furthermore, a stroke length 2414 may be created in an annulus between sliding sleeve 2412 and second coupling joint 2420, which defines a length sliding sleeve 2412 and may later slide until a distal end of sliding sleeve 2412 abuts ledge 2422.

Inner sleeve 2450 may be configured to be radially positioned within elements such as downhole casing 2430, and stroke tool 2405. The inner sleeve 2450 may have a series of ports 2455 that extend into an annulus where sliding sleeve 2412 is positioned. This may allow pressure from an area inside of the inner sleeve 2450 to be applied to sliding sleeve 2412. Responsive to this applied pressure being sufficient enough, temporary coupling mechanisms 2410 may break, while will allow sliding sleeve 2412 to move downhole. Furthermore, an inner profile of sleeve 2450 may have a constant inner diameter. This may allow for tools, such as wiper plugs, to be pumped through inner sleeve 2450.

Figure 25:
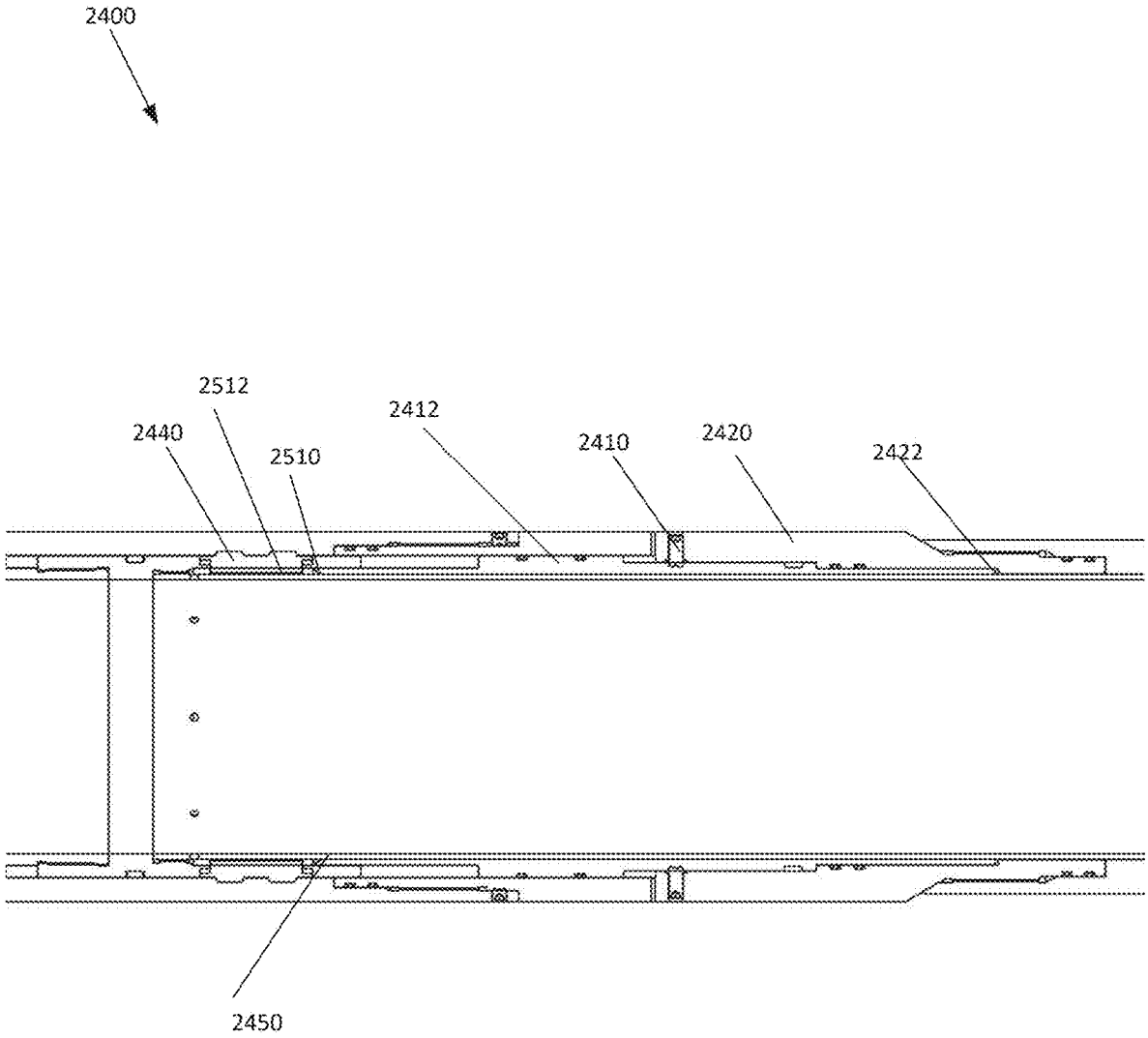

FIG. 25 depicts a detailed view of stroke tool 2400, according to an embodiment. Elements depicted in FIG. 25 may be described above, and for the sake of brevity, a further description of these elements may be omitted.

As depicted in FIG. 25, as the pressure within inner sleeve 2450 increases, this pressure may be communicated to a proximal end of sliding sleeve 2412 via ports 2455. When the pressure increases past a predetermined threshold, temporary coupling mechanisms 2410 may break, allowing sliding sleeve 2412 to move downhole until a distal end of sliding sleeve 2412 contacts ledge 2422.

After sliding sleeve 2412 moves downhole, within an annulus between inner sleeve 2450 and second coupling joint 2420, the proximal end of sliding sleeve 2412 may no longer be aligned with dogs 2440.

Figure 26:
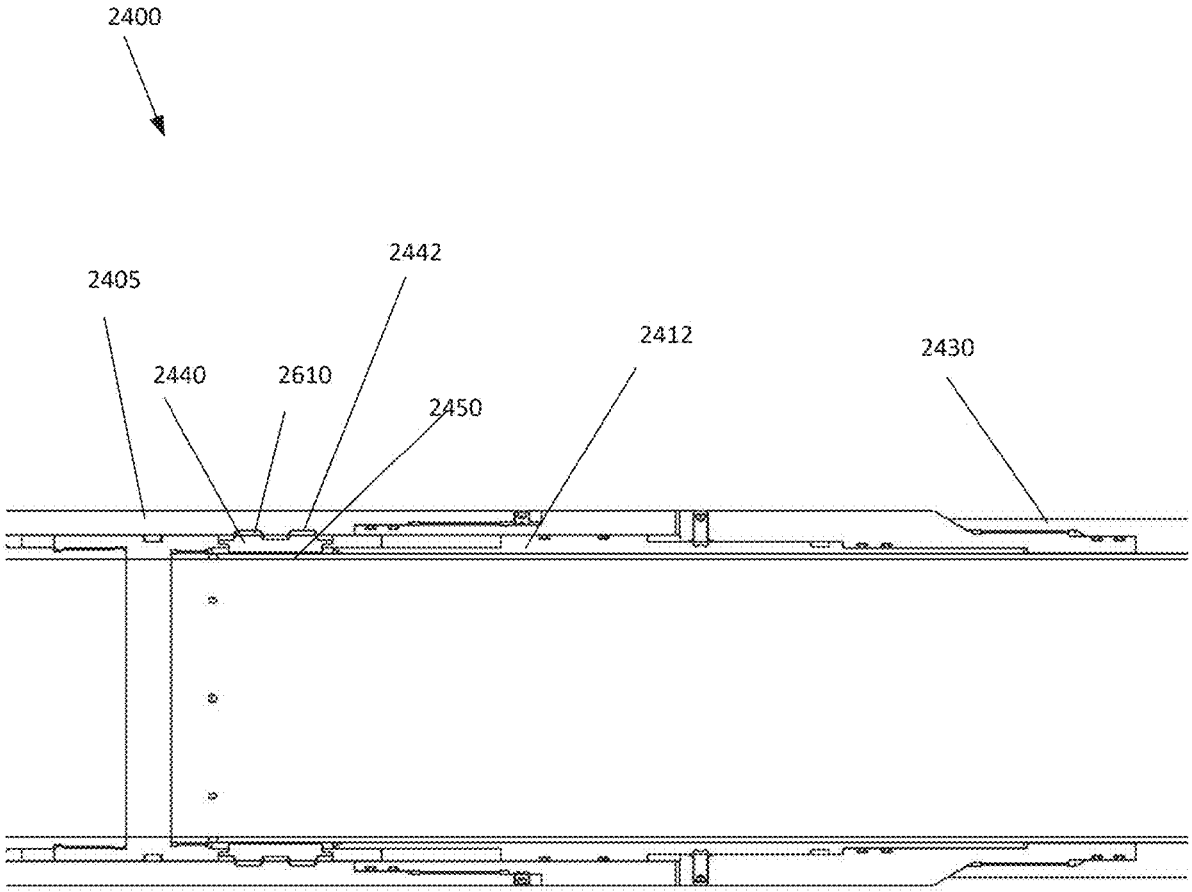

FIG. 26 depicts a detailed view of stroke tool 2400, according to an embodiment. Elements depicted in FIG. 26 may be described above, and for the sake of brevity, a further description of these elements may be omitted.

After sliding sleeve 2412 slides downhole, dogs 2440 may automatically slide radially inward until the outer diameter of inner sleeve 2450. This radial movement of dogs 2440 may cause a radial space 2610 between the outer diameter of dogs 2440 and recesses 2442. This space 2610 may allow stroke tool 2405 to move axially, and downhole, relative to a fixed inner sleeve 2450.

Figure 27:
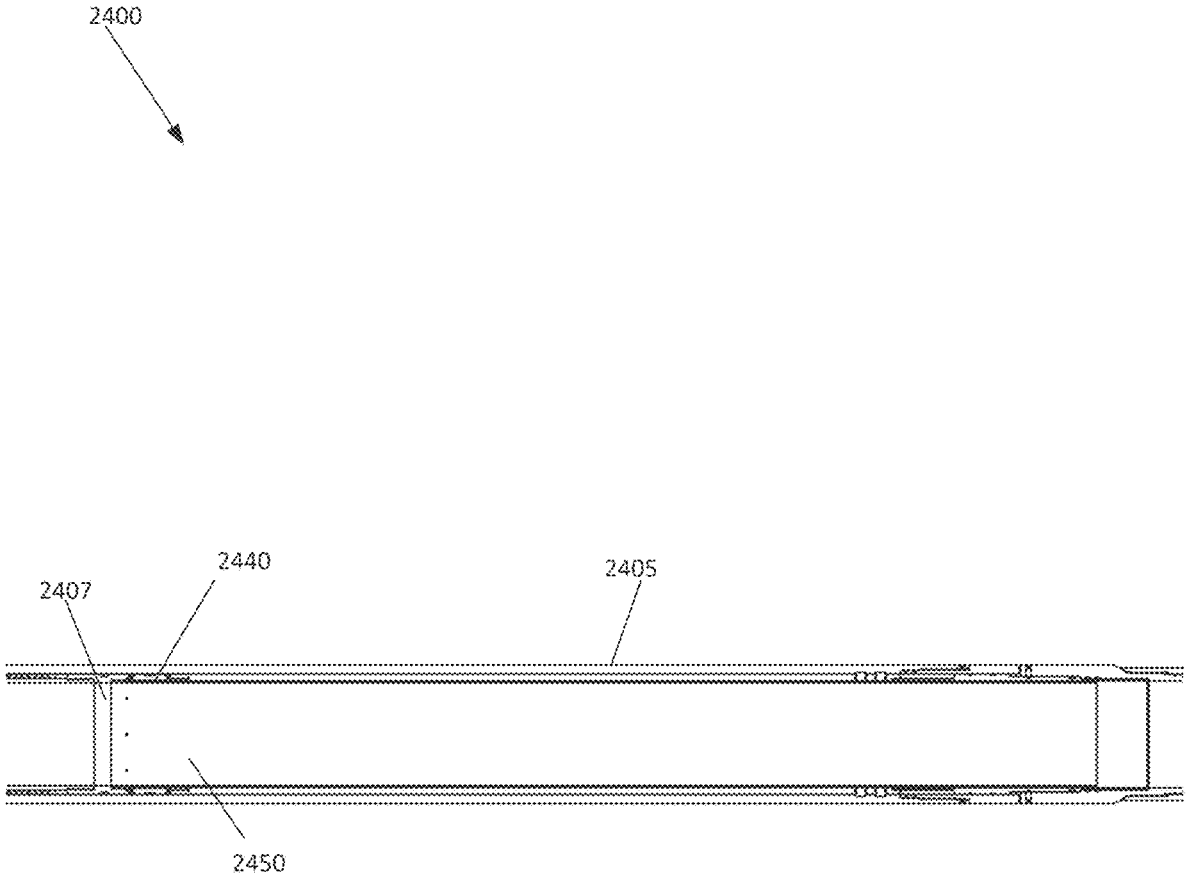

FIG. 27 depicts a detailed view of stroke tool 2400, according to an embodiment. Elements depicted in FIG. 27 may be described above, and for the sake of brevity, a further description of these elements may be omitted.

As depicted in FIG. 27, stroke tool 2405 may move downhole after it is no longer axially locked by dogs 2440.

Reference throughout this specification to "one embodiment", "an embodiment", "one example" or "an example" means that a particular feature, structure, or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures, or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale. For example, in embodiments, the length of the dart may be longer than the length of the tool.

Although the present technology has been described in detail for illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

What is claimed is:

1. A tool for rotating cement downhole, the tool comprising:

a wellhead with a conductor and a seat, the conductor being a first string installed in a well;

a seal assembly configured to engage with an inner diameter of the wellhead to isolate production tubing conduit from an annulus, wherein the seal assembly is configured to be pulled upward away from the wellhead via an upward force;

a downhole stroke tool with a stroke length;

an upper casing coupled to the seal assembly and temporarily coupled to the stroke tool via temporary coupling mechanisms, wherein the seal assembly is configured to be lifted upward away from the wellhead along with the upper casing after shearing the temporary coupling mechanisms and, the seal assembly is configured to be rotated to rotate the upper casing, wherein the upper casing is lifted the stroke length associated with the downhole stroke tool, and wherein the upward force shears the temporary coupling mechanisms;

a lower casing positioned below the downhole stroke tool, the lower casing being configured to remain stationary while the upper casing is lifted upward and rotated.

2. The tool of claim 1, wherein the seal assembly cannot rotate when the seal assembly is positioned on the seat.

3. The tool of claim 1, wherein the downhole stroke tool includes a first coupler joint, second coupler joint, and a stroking sleeve, wherein the upper casing is configured to move axially relative to the downhole stroke tool to move the seal assembly away from the wellhead.

4. The tool of claim 3, wherein the seal assembly is configured to move away from the wellhead during a first stage cement job, positioned on the seat to expand downhole packers, and once again moved away from the wellhead during a second stage cement job.

5. The tool of claim 4, wherein the first coupler joint has a proximal inner diameter that is coupled to an outer diameter of a distal end of the upper casing, and the first coupler joint has a distal inner diameter that is temporarily coupled to an outer diameter of a proximal end of the second coupler joint.

6. The tool of claim 5, wherein the second coupler joint has an outer diameter that is coupled to a distal end of the stroking sleeve, and the second coupler joint has an inner diameter that is coupled to an outer diameter of a first tubing.

7. The tool of claim 6, wherein the first tubing is coupled to a rotating tool, the rotating tool allowing the relative rotation between the first tubing and a second tubing in a first direction, and rotationally locking the first tubing and the second tubing in a second direction.

8. The tool of claim 1, further comprising:

a packer configured to radially expand across the annulus, wherein the seal assembly is lifted away from the wellhead and rotated to rotate the upper casing while the packer is radially expanded.

9. The tool of claim 1, wherein the seal assembly and the wellhead are rotationally locked when the seal assembly is positioned on the seat.

* * * * *